US009533800B2

(12) United States Patent
Frishman

(10) Patent No.: US 9,533,800 B2
(45) Date of Patent: Jan. 3, 2017

(54) BOTTLE CROWN WITH OPENER ASSEMBLY

(71) Applicant: WORLD BOTTLING CAP, LLC, Carrollton, TX (US)

(72) Inventor: Abe Frishman, Carrollton, TX (US)

(73) Assignee: WORLD BOTTLING CAP, LLC, Carrollton, TX (US)

( * ) Notice: Subject to any disclaimer, the term of this patent is extended or adjusted under 35 U.S.C. 154(b) by 74 days.

(21) Appl. No.: 14/244,571

(22) Filed: Apr. 3, 2014

(65) Prior Publication Data

US 2015/0274353 A1 Oct. 1, 2015

(30) Foreign Application Priority Data

Mar. 28, 2014 (TW) ..... 103111634 A

(51) Int. Cl.
*B65D 41/04* (2006.01)
*B65D 41/42* (2006.01)

(52) U.S. Cl.
CPC ..... *B65D 41/42* (2013.01)

(58) Field of Classification Search
CPC ..... B65D 17/165; B65D 41/34; B65D 41/12; B65D 41/42
USPC ..... 220/663; 215/328
See application file for complete search history.

(56) References Cited

U.S. PATENT DOCUMENTS

| | | | |
|---|---|---|---|
| 771,712 | A | 10/1904 | Coale et al. |
| 786,521 | A | 4/1905 | Schroeder |
| 800,867 | A | 10/1905 | Mulvaney |
| 814,531 | A | 3/1906 | Gillette |
| 876,149 | A | 1/1908 | Cook |
| 1,168,386 | A | 1/1916 | Gaston |
| 1,233,896 | A | 7/1917 | McDonnell |
| 1,294,171 | A | 2/1919 | Rockwell |
| 1,413,256 | A | 4/1922 | Carvalho et al. |
| 1,516,207 | A | 11/1924 | Rockwell |
| 1,639,857 | A | 8/1927 | Planski |
| 1,693,117 | A | 11/1928 | McDonnell |
| 1,899,210 | A | 2/1933 | Ramsay |
| 2,046,173 | A | 6/1936 | Lenhoff |
| 2,099,056 | A | 11/1937 | Ferngren |
| 2,104,344 | A | 1/1938 | Heymann |
| 2,187,454 | A | 1/1940 | Hutaff, Jr. |
| 2,191,447 | A | 2/1940 | Beardsley |

(Continued)

FOREIGN PATENT DOCUMENTS

| | | | |
|---|---|---|---|
| BE | 503394 | A | 6/1951 |
| CN | 2094345 | | 1/1992 |
| CN | 201321197 | Y | 10/2009 |

(Continued)

OTHER PUBLICATIONS

International Search Report and Written Opinion for PCT/US2015/013464, dated May 15, 2015.

(Continued)

*Primary Examiner* — Jeffrey Allen
(74) *Attorney, Agent, or Firm* — James H. Ortega; Carstens & Cahoon, LLP

(57) ABSTRACT

A crown for a bottle or other container has a top portion and an annular skirt that descends contiguously from the top portion. An opener assembly and an arrangement of frangible scoring lines on the crown allow for ease of opening the bottle or container. Corrugated embodiments provide material strengthening for a reduced gauge crown.

25 Claims, 44 Drawing Sheets

(56) References Cited

U.S. PATENT DOCUMENTS

| | | | | |
|---|---|---|---|---|
| 2,233,904 | A | 3/1941 | Wagner | |
| 2,327,454 | A | 8/1943 | Punte | |
| 2,327,455 | A | 8/1943 | Punte | |
| 2,387,955 | A | 10/1945 | Tilson | |
| 2,696,318 | A | 12/1954 | Kihm | |
| 2,829,790 | A | 4/1958 | Isele-Aregger | |
| 3,057,501 | A | 10/1962 | Kroenert | |
| 3,122,253 | A | 2/1964 | Hagmann et al. | |
| 3,195,755 | A | 7/1965 | Scharf | |
| 3,199,705 | A | 8/1965 | Brockett | |
| 3,206,055 | A | 9/1965 | Helbling | |
| 3,207,350 | A | 9/1965 | Hagmann et al. | |
| 3,266,659 | A | 8/1966 | Frankenberg | |
| 3,268,368 | A | 8/1966 | Mackiw et al. | |
| 3,380,609 | A | 4/1968 | Potts | |
| 3,450,291 | A | 6/1969 | Lovell | |
| 3,451,367 | A | 6/1969 | Henrickson | |
| 3,462,036 | A | 8/1969 | Chaolu | |
| 3,479,790 | A | 11/1969 | LaBarge | |
| 3,480,173 | A | 11/1969 | Wheaton | |
| 3,522,899 | A | 8/1970 | Siemonsen et al. | |
| 3,540,611 | A | 11/1970 | Nishikawa | |
| 3,545,638 | A | 12/1970 | Brown | |
| 3,556,336 | A | 1/1971 | Coop | |
| 3,561,631 | A | 2/1971 | Hatfield et al. | |
| 3,598,272 | A | 8/1971 | Bustamante et al. | |
| 3,618,816 | A | 11/1971 | Brown | |
| 3,630,405 | A | 12/1971 | Podesta | |
| 3,674,172 | A | 7/1972 | Wells et al. | |
| 3,701,454 | A | 10/1972 | Thorp et al. | |
| 3,724,700 | A | 4/1973 | Heffran | |
| 3,734,333 | A | 5/1973 | Foss | |
| 3,743,129 | A * | 7/1973 | Willis | B65D 41/40 215/255 |
| 3,823,841 | A | 7/1974 | Lovejoy | |
| 3,834,573 | A | 9/1974 | Amos | |
| 3,851,793 | A | 12/1974 | Brown | |
| 3,870,184 | A | 3/1975 | Fuchs et al. | |
| 3,905,503 | A | 9/1975 | Fraze | |
| 3,908,856 | A | 9/1975 | Perry | |
| 3,920,142 | A | 11/1975 | Vandrebeck et al. | |
| 3,931,904 | A | 1/1976 | Coop | |
| 3,940,254 | A | 2/1976 | McMullen et al. | |
| 3,957,172 | A | 5/1976 | Hasegawa | |
| 3,958,710 | A | 5/1976 | Harding et al. | |
| RE28,862 | E | 6/1976 | Siemonsen et al. | |
| 3,963,140 | A | 6/1976 | Harding | |
| 3,963,141 | A | 6/1976 | Liu | |
| 3,979,002 | A | 9/1976 | Faulstich | |
| 4,003,488 | A | 1/1977 | Moller | |
| 4,004,705 | A | 1/1977 | Fujio | |
| 4,060,172 | A | 11/1977 | Amabili | |
| 4,066,180 | A | 1/1978 | Sanchez | |
| 4,087,018 | A | 5/1978 | Tebbutt | |
| 4,089,753 | A | 5/1978 | McMullen et al. | |
| 4,106,422 | A | 8/1978 | Buhrke | |
| 4,176,014 | A | 11/1979 | Ruscoe et al. | |
| 4,184,605 | A | 1/1980 | Hanson | |
| 4,227,619 | A | 10/1980 | Magnusson | |
| 4,247,374 | A | 1/1981 | Ruscoe et al. | |
| 4,279,968 | A | 7/1981 | Ruscoe et al. | |
| 4,318,493 | A | 3/1982 | Jacobsen et al. | |
| 4,453,644 | A | 6/1984 | Berglund | |
| 4,465,204 | A | 8/1984 | Kaminski et al. | |
| RE31,869 | E | 4/1985 | Harding | |
| 4,534,481 | A | 8/1985 | Summers et al. | |
| 4,569,621 | A | 2/1986 | Sjogren et al. | |
| 4,579,761 | A | 4/1986 | Ruscoe et al. | |
| 4,733,793 | A | 3/1988 | Moen | |
| 4,768,667 | A | 9/1988 | Magnusson | |
| 4,930,656 | A | 6/1990 | Bianchette | |
| 5,020,686 | A | 6/1991 | Dutt | |
| 5,069,345 | A | 12/1991 | Irwin | |
| 5,080,245 | A | 1/1992 | Conard | |
| 5,143,241 | A | 9/1992 | Szymanski | |
| 5,145,084 | A | 9/1992 | Murayama et al. | |
| 5,458,253 | A | 10/1995 | Shapcott | |
| 5,741,105 | A | 4/1998 | Schubert et al. | |
| 5,799,816 | A | 9/1998 | Schubert | |
| 5,924,739 | A | 7/1999 | Garbutt | |
| 6,006,933 | A | 12/1999 | Henning et al. | |
| 6,105,806 | A | 8/2000 | Stasiuk | |
| 6,138,856 | A | 10/2000 | Ghim et al. | |
| 6,283,318 | B1 | 9/2001 | Lee | |
| 6,336,307 | B1 | 1/2002 | O'Connor | |
| 6,533,518 | B1 | 3/2003 | Turner et al. | |
| 6,808,351 | B1 | 10/2004 | Brown et al. | |
| 8,061,544 | B2 * | 11/2011 | Frishman | B65D 41/12 215/255 |
| 8,276,773 | B2 | 10/2012 | Frishman | |
| 8,365,940 | B2 | 2/2013 | Frishman | |
| 8,608,006 | B2 | 12/2013 | Frishman | |
| 8,944,264 | B2 | 2/2015 | Frishman | |
| 9,321,562 | B2 | 4/2016 | Frishman | |
| 2002/0104852 | A1 | 8/2002 | Staniszewski et al. | |
| 2002/0195414 | A1 | 12/2002 | Kim et al. | |
| 2003/0053890 | A1 | 3/2003 | Turner et al. | |
| 2003/0092364 | A1 | 5/2003 | Erickson et al. | |
| 2003/0150834 | A1 | 8/2003 | Verderber | |
| 2003/0201266 | A1 | 10/2003 | Steffan | |
| 2005/0092751 | A1 | 5/2005 | Alvares et al. | |
| 2005/0279432 | A1 | 12/2005 | Takeuchi et al. | |
| 2007/0181526 | A1 | 8/2007 | Frishman | |
| 2010/0096355 | A1 | 4/2010 | Chaolu | |
| 2010/0183406 | A1 | 7/2010 | Gysi et al. | |
| 2010/0200534 | A1 | 8/2010 | Frishman | |
| 2010/0326949 | A1 | 12/2010 | Merino Caballero | |
| 2011/0024381 | A1 | 2/2011 | Frishman | |
| 2012/0261380 | A1 | 10/2012 | Frishman | |
| 2012/0308337 | A1 | 12/2012 | Gysi et al. | |
| 2015/0034586 | A1 | 2/2015 | Frishman | |
| 2015/0157535 | A1 | 6/2015 | Frishman | |
| 2015/0284136 | A1 | 10/2015 | Frishman | |
| 2015/0298868 | A1 | 10/2015 | Frishman | |
| 2015/0314362 | A1 | 11/2015 | Frishman | |
| 2016/0083136 | A1 | 3/2016 | Frishman | |

FOREIGN PATENT DOCUMENTS

| | | | |
|---|---|---|---|
| CN | 201729365 | U | 2/2011 |
| CN | 103998348 | A | 8/2014 |
| DE | 1038934 | B | 9/1958 |
| DE | 2015629 | | 10/1971 |
| DE | 8527425 | | 1/1986 |
| DE | 3906112 | | 8/1990 |
| DE | 29600761 | | 1/1997 |
| EP | 0262767 | | 4/1988 |
| FR | 322592 | A | 2/1903 |
| FR | 2118176 | A1 | 7/1972 |
| GB | 599704 | A | 3/1948 |
| GB | 759417 | A | 10/1956 |
| GB | 1377767 | | 12/1974 |
| GB | 1279068 | | 6/1976 |
| GB | 1540229 | | 2/1979 |
| JP | S47-4776 | Y1 | 2/1972 |
| JP | S56-161525 | | 5/1983 |
| JP | S 60-2448 | | 1/1985 |
| JP | S61-112350 | U | 1/1986 |
| JP | S62-108250 | | 7/1987 |
| JP | H02-087756 | | 3/1990 |
| JP | 3533626 | B2 | 3/2004 |
| JP | 2005047621 | A | 2/2005 |
| WO | WO 0051906 | | 9/2000 |
| WO | WO 0071430 | | 11/2000 |
| WO | WO 2006048903 | | 5/2006 |
| WO | WO 2009009429 | | 1/2009 |
| WO | WO 2009035472 | | 3/2009 |
| WO | 2013052219 | A1 | 4/2013 |

OTHER PUBLICATIONS

International Search Report for PCT/US2012/053131 dated Dec. 18, 2012.

(56) References Cited

OTHER PUBLICATIONS

International Preliminary Report on Patentability for PCT/US2012/053131 dated Jun. 11, 2013.
International Search Report for PCT/US2014/032870, dated Aug. 18, 2014.
International Search Report and Written Opinion for PCT/US2015/028541, dated Jul. 22, 2015.
International Search Report for PCT/US2006/002421 dated Oct. 17, 2006.
International Preliminary Report on Patentability for PCT/US2006/002421, dated Jul. 15, 2008.
International Search Report for PCT/US2008/000891, dated Jul. 16, 2008.
International Preliminary Report on Patentability for PCT/US2008/000891, dated Jul. 28, 2009.
International Search Report for PCT/US2011/067134, dated Apr. 24, 2012.
International Preliminary Report on Patentability for PCT/US2011/067134, dated Apr. 8, 2014.
International Search Report for PCT/US2012/047949, dated Nov. 5, 2012.
International Preliminary Report on Patentability for PCT/US2012/047949, dated Jun. 3, 2013.
Supplementary European Search Report for EP 12838359 dated Jan. 23, 2015.
International Search Report for PCT/US2014/014555, dated May 22, 2014.
International Preliminary Report on Patentability for PCT/US2014/014555, dated Mar. 23, 2015.
Supplemental European Search Report for EP14745376.5 dated Sep. 8, 2016.
International Search Report and Written Opinion for PCT/US2015/063384, dated Sep. 22, 2016.

* cited by examiner

BOTTLE CROWN WITH OPENER ASSEMBLY

CROSS-REFERENCE TO RELATED APPLICATIONS

This application is related to, claims the benefit of and priority from co-pending Taiwan patent application Ser. No. 103111634, filed Mar. 28, 2014, entitled BOTTLE CROWN WITH OPENER ASSEMBLY, by the same inventor, the disclosure of which is incorporated herein by reference. In addition, the disclosures of U.S. Pat. Nos. 8,061,544, 8,276,773, 8,365,940, and 8,608,006, by the same inventor, are incorporated herein by reference.

FIELD OF THE DISCLOSURE

The present disclosure relates to caps and crowns for beverage bottles and other containers, and in particular, to a manual pull-to-open bottle cap.

BACKGROUND

A beverage bottle that opens manually with relative ease, without the use of a bottle opener, has been a long-felt need for beverage providers. Bottle caps must be tightly secured to the bottle opening to prevent spillage of the contents, loss of pressure (in the case of pressurized or carbonated beverages) and to maintain the hygienic conditions of the contents. The tight seal makes it difficult to open a bottle by hand.

Caps, also referred to interchangeably as crowns, are secured to the bottle opening by crimping the crown down over the open of the container in a series of concave arcs around the circumference of the opening. The arcs create sharp convex points between each concave arc. The arcs and points are often referred to by those skilled in art as "angles" or "flutes."

The advent of the familiar twist-off bottle cap was a significant advance for manual bottle opening, but all too frequently one has to grip the cap so hard to twist the cap free that the points of the cap angles inflict pain on the hands or fingers. To protect the hands from injury, it is a common practice to wrap the bottle cap in the tail of a shirt or in a cloth before twisting the cap.

Bottle caps adapted with pull tabs, similar to those used for beverage cans, have been known in China and other territories of Asia. See, for example, International Patent Application PCT/CN00/00040 by Liu, priority date Mar. 4, 1999, International Publication No. WO00/51906. Such pull tab bottle caps, however, are notoriously difficult to open because they require the exertion of an uncomfortable amount of force to break the seal and then pull the tab back (tearing the metal) to remove the cap.

Another pull-tab solution for bottle caps is known as the MaxiCrown® such as is described U.S. Pat. No. 4,768,667 issued Sep. 6, 1988, to Magnusson. The MaxiCrown® provides a pull ring disposed along the side of the neck of the bottle as an extension of the crown and thus is problematic for use with standard angle-crimping bottle capping machines Indeed, a special capping machine is recommended to cap bottles with the MaxiCrown®.

There is a need, therefore, for a bottle crown that is easy to open manually yet which may be tightly sealed around the bottle opening using standard bottle capping machines common in the art.

BRIEF DESCRIPTION OF THE DRAWINGS

The detailed description that follows, by way of non-limiting examples of embodiments, makes reference to the noted drawings in which reference numerals represent the same parts throughout the several views of the drawings, and in which.

DETAILED DESCRIPTION

In view of the foregoing, through one or more various aspects, embodiments and/or specific features or sub-components, the present disclosure is thus intended to bring out one or more of the advantages that will be evident from the description. The present disclosure makes reference to one or more specific embodiments by way of illustration and example. It is understood, therefore, that the terminology, examples, drawings and embodiments are illustrative and are not intended to limit the scope of the disclosure. The terms "crown" and "cap" may be used interchangeably in the description that follows.

Figure 1:
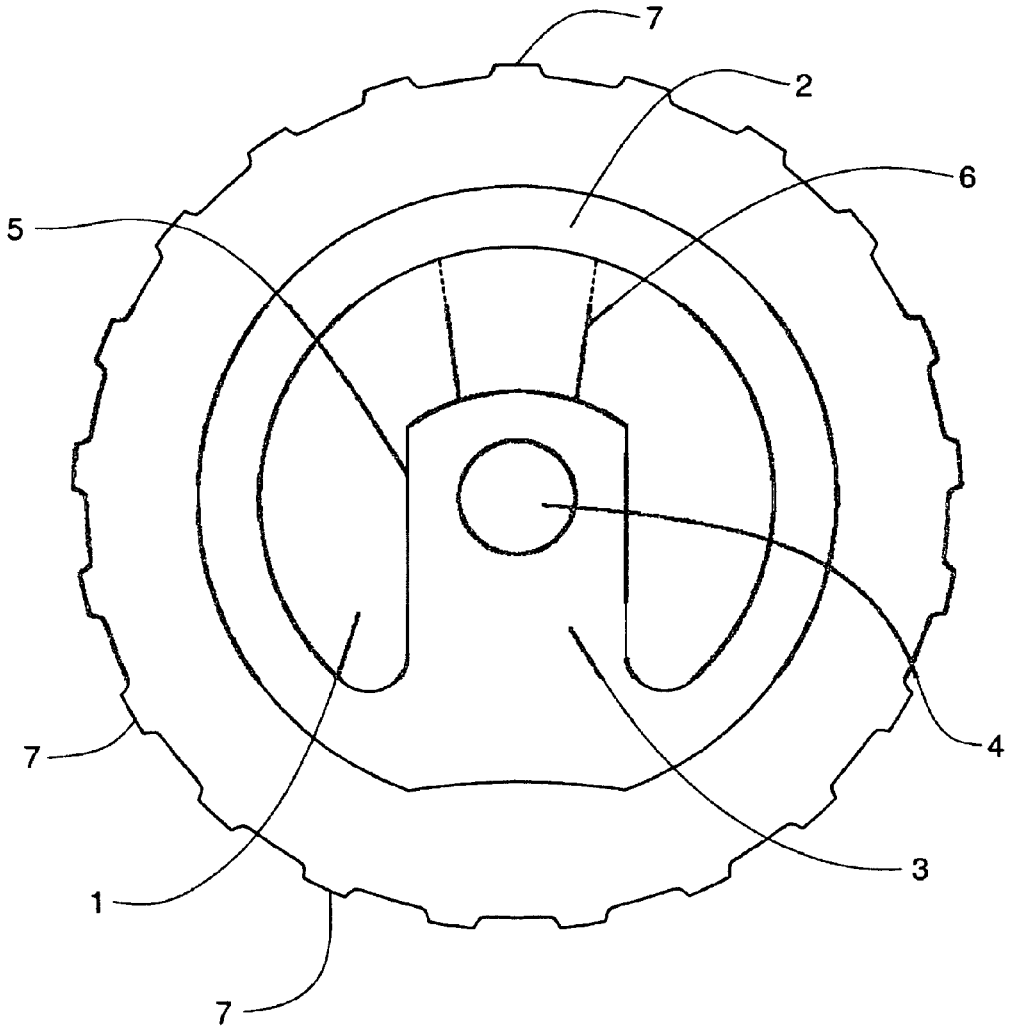
FIG. 1 Prior Art
FIG. 1 is a diagrammatic representation of a top view of a specific exemplary embodiment of a bottle cap of the prior art.

FIG. 1 is a diagrammatic representation of a top view of a specific exemplary embodiment of a bottle cap of the prior art. The lever-type, easy-opening cap shown in FIG. 1 may have crown 1, pull tab ring 2, pull tab 3, rivet 4, and lever 5. Cutting lines 6 may form a horizontal angle of approximately 30 degrees may be provided at the back of the crown cap 1. Significantly, cutting lines 6 do not extend all the way to the rim edge of crown 1, but instead terminate at or near ring 2. A plurality of angles 7 may be formed by crimping cap 1 around a circular bottle opening. Not shown in this view is that, in vertical cross section, cutting lines 6 of the prior art maintain substantially the same depth profile along the length of the cut. A consequence of these various features is that undue manual force may be required to open and remove a crown of FIG. 1 from a container opening.

Crown or cap 1 may be connected to pull tab 3 by lever 5. Lever 5 and pull tab 3 may be joined to make a single unit. Likewise, pull tab 3 and pull tab ring 2 may be a unitary piece. The other end of pull tab 3 may be riveted to the approximate center of the surface on the body of the cap of crown cap 1 by rivet 4.

Figure 2A:
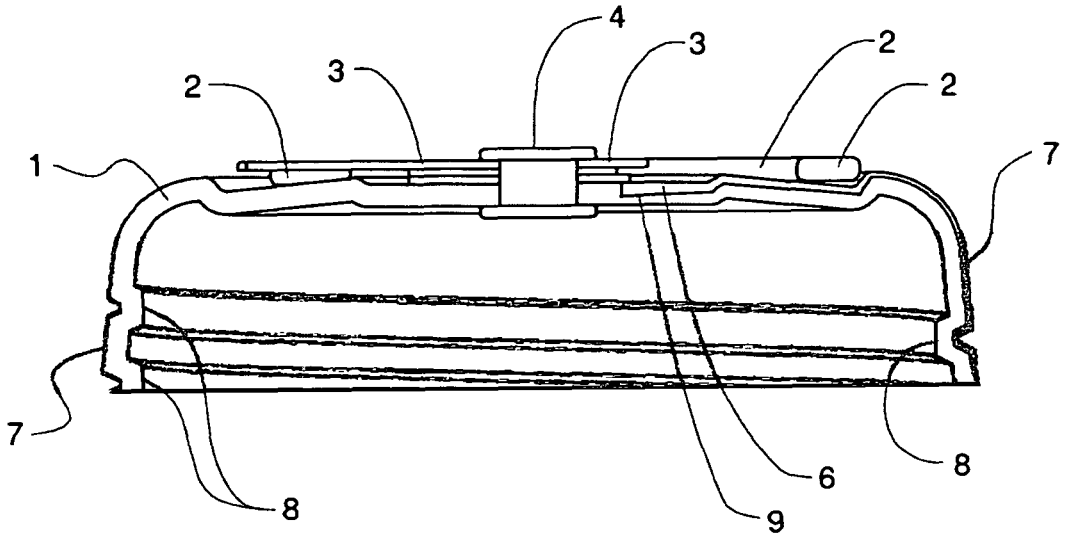
FIG. 2A is a diagrammatic representation of a side view vertical cross-section of a specific exemplary embodiment of a bottle cap of the present disclosure.

FIG. 2A is a diagrammatic representation of a side view vertical cross-section of a specific exemplary embodiment of a bottle cap of the present disclosure. Pull tab ring 2, pull tab 3 and rivet 4 in combination may be referred to herein from time to time as an opener assembly. Interior threads 8 may be provided for selectively removing crown 1 from a bottle by manually twisting instead of using the opener assembly mechanism.

Cutting line 6 tapers downward from angle 7 at the rim of cap 1 toward the approximate center of cap 1 to provide a tapered tearing groove. For example, the depth of the tapered groove may graduate from a depth in the range of approximately 0.03 to 0.02 mm near the rim of cap 1 to a depth in the range of approximately 0.10 to 0.08 mm by rivet 4 near the center of cap 1.

Figure 2B:
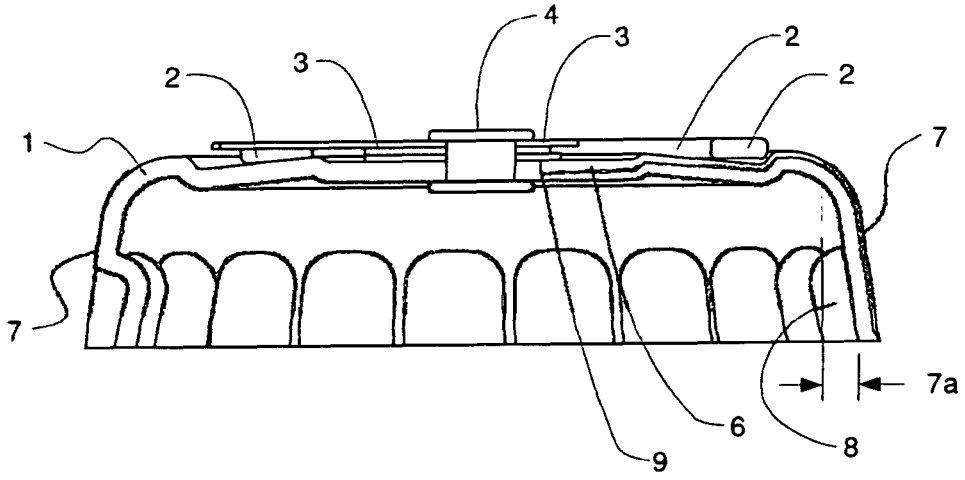
FIG. 2B is a diagrammatic representation of a side view vertical cross-section of an alternative specific exemplary embodiment of the bottle cap of FIG. 2A.

FIG. 2B is a diagrammatic representation of a side view vertical cross-section of an alternative specific exemplary embodiment of the bottle cap of FIG. 2A. The embodiment of FIG. 2B lacks threads 8 and is thus adapted to be opened manually using the opener assembly as described above. Also shown is rim or rim area 7*a*, which may be considered the portion of crown 1 that may be crimped over the opening of a bottle, forming the angles, to secure the crown onto the bottle. Rim 7*a* may be considered to extend from approximately the portion of crown 1 that begins to curve over a bottle opening, or slightly interior to that portion, to the terminus of angle 7.

While terminus 9 of the tearing groove near the center of cap 1 is depicted in FIGS. 2A and 2B as being substantially vertical, it will be understood by those skilled in the art that a selected profile or dimensions of the tearing groove employed in a specific embodiment of a bottle cap of the present disclosure are a question of design and engineering choice, and as such the present disclosure should not be read as limiting in such regards. For instance, the present disclosure contemplates that terminus 9 may be curved, slanted, or otherwise shaped consistent with aims of the present disclosure.

Figure 3A:
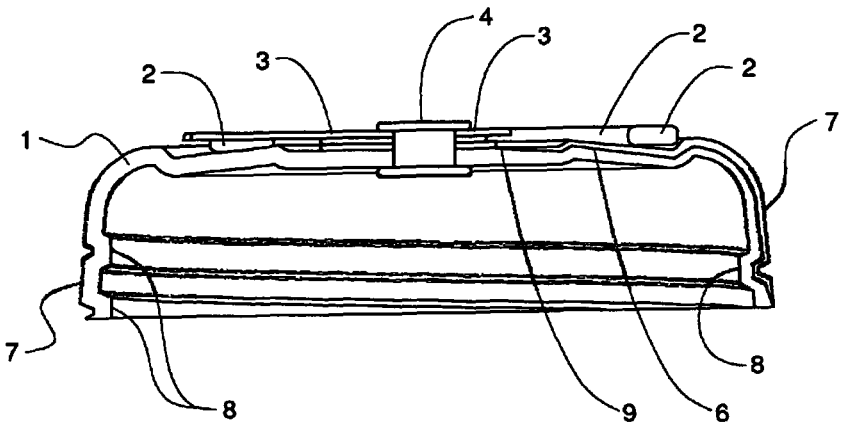
FIG. 3A is a diagrammatic representation of a side view vertical cross-section of an alternative specific exemplary embodiment of a bottle cap of the present disclosure.

FIG. 3A is a diagrammatic representation of a side view vertical cross-section of an alternative specific exemplary embodiment of a bottle cap of the present disclosure. In the embodiment of FIG. 3A, cutting line 6 tapers at terminus 9 as well as toward angle 7 at the rim of cap 1 to provide an alternatively tapered tearing groove in contrast to the embodiment depicted in FIGS. 2A and 2B. By tapering the groove of cutting line 6 such that the thickness of cap 1 increases toward the center and toward the rim, an alternative tearing groove may be provided so that only a reasonable amount of force is called upon to manually tear open cap 1.

Figure 3B:
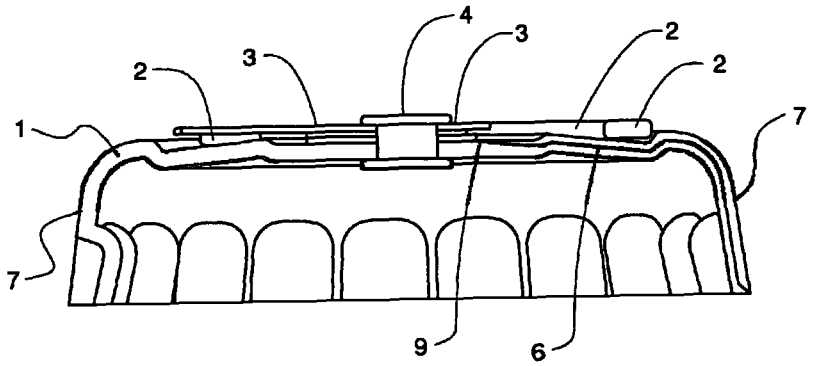
FIG. 3B is a diagrammatic representation of a side view vertical cross-section of an alternative specific exemplary embodiment of the bottle cap of FIG. 3A.

FIG. 3B is a diagrammatic representation of a side view vertical cross-section of an alternative specific exemplary embodiment of the bottle cap of FIG. 3A. The embodiment of FIG. 3B lacks threads 8 and is thus adapted to be opened manually using the opener assembly as described above.

By varying the depth of the groove along cutting line 6, as in either of the embodiments of FIG. 2A, 2B, 3A, or 3B, cap 1 provides a tearing groove which makes it more likely that only a reasonable amount of manual force is called upon to tear open crown 1. As will be discussed in more detail below, a recommended range of dimensions and material composition of crown 1 are disclosed to further provide a crown that may be manually opened with only reasonable force.

In operation, a person grasps ring 2 near tab 3 so as to pivot ring 2 on lever 5 while pulling up and back along cutting line 6. Lever 5 and rivet 4 may act in concert to crack open cap 1 at the center while manual force continues tearing cap 1 along lines 6 until cap 1 is substantially split apart so that cap 1 may be easily removed from a bottle. The tearing groove of cutting line 6 facilitates manually tearing cap 1 along line 6.

Advantageously, the embodiments of FIGS. 2A and 3A may be provided with mating threads 8 along the interior of angles 7 such that crown 1 is adapted to alternatively be opened by twisting or unscrewing crown 1 from a bottle. Also alternatively, cap 1 may be removed using a bottle opener or other means to pop the cap off of the bottle.

Figure 4:
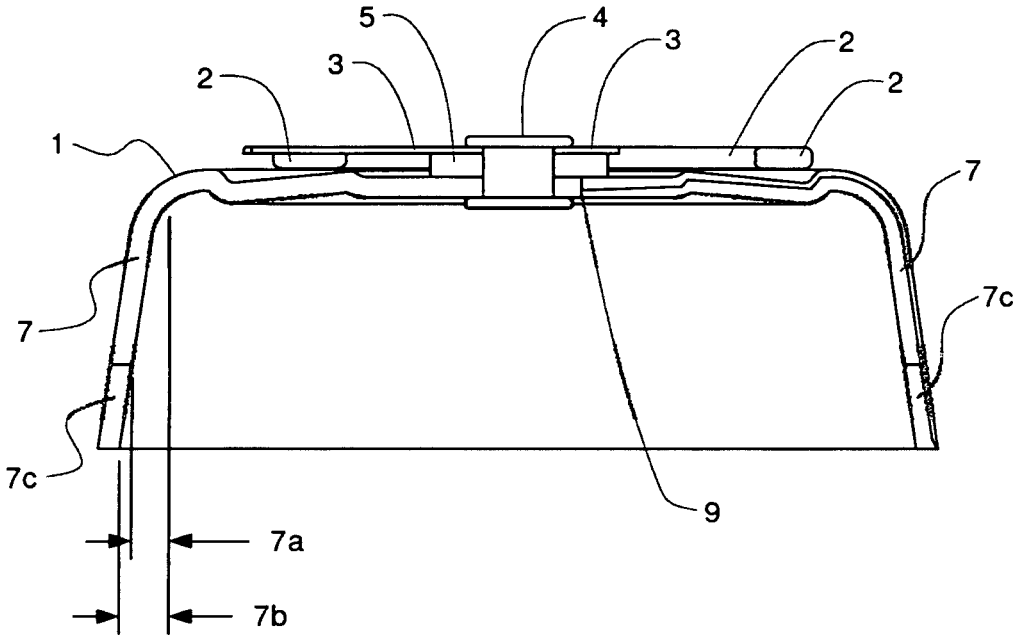
FIG. 4 is a diagrammatic representation of a side view vertical cross-section of an alternative specific exemplary embodiment of a bottle cap of the present disclosure.

FIG. 4 is a diagrammatic representation of a side view vertical cross-section of an alternative specific exemplary embodiment of a bottle cap of the present disclosure. Alternatively or additionally to threads 8, crown 1 may be formed, as shown in FIG. 4, having an elongated rim 7*b* relative to rim 7*a* of FIG. 2. Securing a standard crown over a threaded bottle opening may be problematic because the threads add surface area to the exterior of the bottle opening. A standard crown may not be big enough to extend over the extra surface area of a threaded bottle. Elongated rim 7*b* may be an advantageous alternative embodiment that allows crown 1 to be crimped over a threaded bottle opening to provide elongated angle 7*c*. A further advantage is that a crown of FIG. 4 may be twisted off of a threaded bottle without the crown itself being interiorly threaded such as depicted in FIGS. 2A and 3A.

Lever 5 is provided for leverage and additional shearing force to rend open the tinplate material of crown 1.

Figure 5:
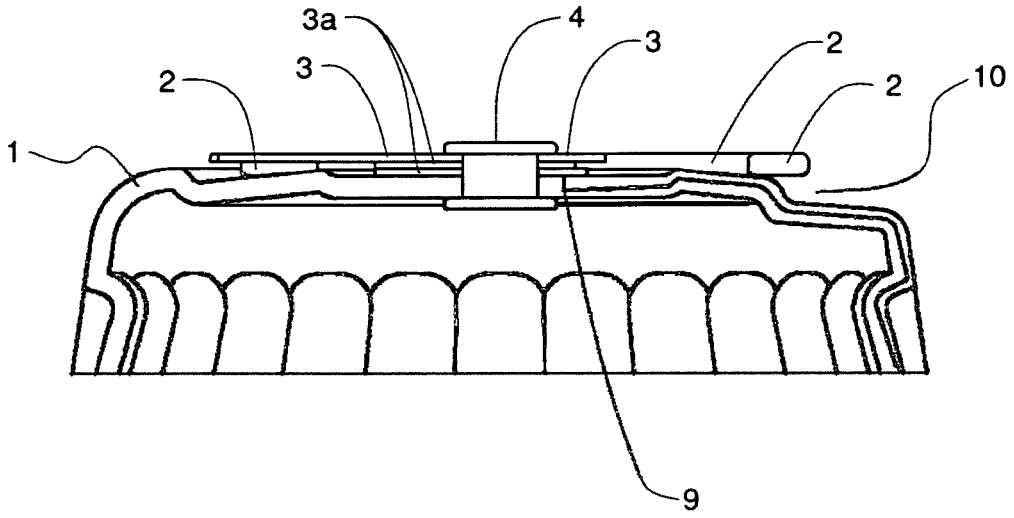
FIG. 5 is a diagrammatic illustration of a side view cross-section of an alternative embodiment of a crown of the present disclosure.

FIG. 5 is a diagrammatic illustration of a side view cross-section of an alternative embodiment of a crown of the present disclosure. In the embodiment of FIG. 5, lever 5 is omitted such that pull tab ring 2 and pull tab 3 are proximate to the top of crown 1. A crown of the present disclosure may provide divot 10 under pull tab ring 2 to facilitate manual grasping of ring 2. That is, divot 10 may provide a void into which a finger tip or a finger nail may fit to exert upward force on ring 2.

Figure 6:
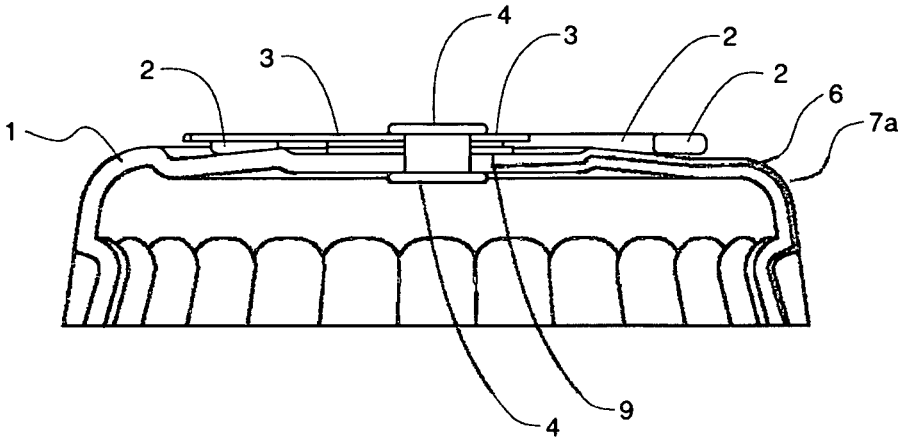
FIG. 6 is a diagrammatic illustration of a side view cross-section of yet another alternative embodiment of a crown of the present disclosure.

FIG. 6 is a diagrammatic illustration of a side view cross-section of yet another alternative embodiment of a crown of the present disclosure. Cut line 6 extends into rim area 7*a* so as to curve downward toward angle 7 to the edge of crown 1.

Figure 7:
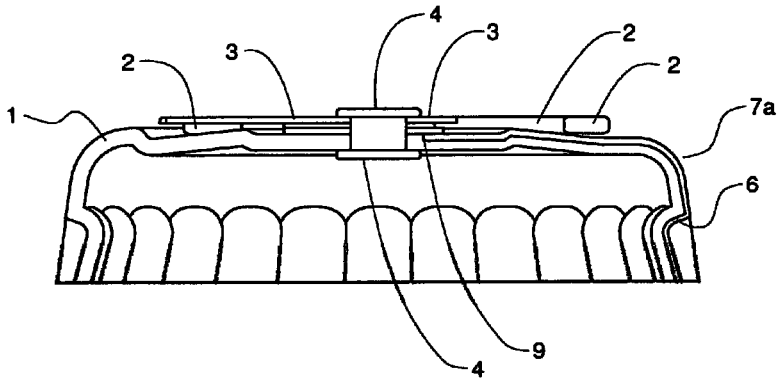
FIG. 7 is a diagrammatic illustration of a side view cross-section of an alternative embodiment of a crown of FIG. 6.

FIG. 7 is a diagrammatic illustration of a side view cross-section of an alternative embodiment of a crown of FIG. 6. Cut line 6 into extends into rim 7*a*, as with FIG. 6, but the depth of cut line 6 is substantially uniform along its length rather than having a variable depth as previously described.

Figure 8:
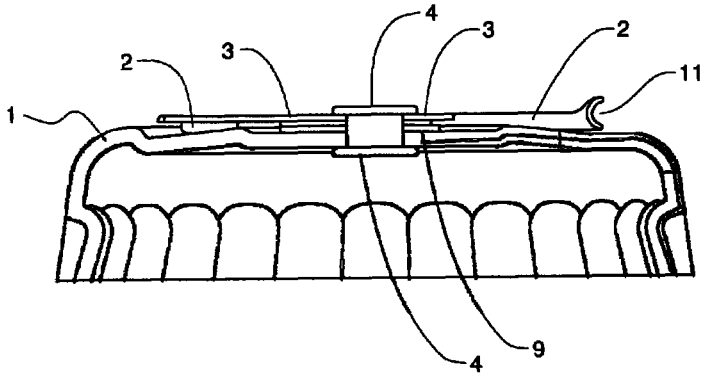
FIG. 8 is a diagrammatic illustration of a side view cross-section of another alternative embodiment of a crown of the present disclosure.

FIG. 8 is a diagrammatic illustration of a side view cross-section of another alternative embodiment of a crown of the present disclosure. Pull tab ring 2 may be provided with one or more arcuate portions 11 to facilitate manual grasping of ring 2 by providing an uplifted space to accommodate a finger tip or finger nail underneath. Arcuate portion 11 is shown for illustration purposes only. The amount or angle of uplift or curvature may be a matter of design choice for a specific embodiment.

Figure 9:
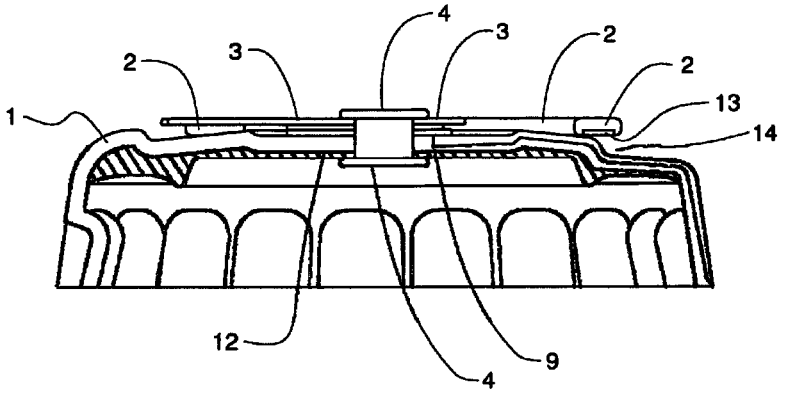
FIG. 9 is a diagrammatic illustration of a side view cross-section of still another alternative embodiment of a crown of the present disclosure.

FIG. 9 is a diagrammatic illustration of a side view cross-section of still another alternative embodiment of a crown of the present disclosure. Liner 12 is secured under crown 1 with rivet 4. Cushion 13 is disposed under pull tab ring 2 to facilitate manual grasping of ring 2 and further to provide tactile comfort by reducing metal-to-skin contact when ring 2 is grasped by a person. Divot 14, similar to divot 10 in FIG. 5, may be an indented portion of crown 1 such that the indentation extends under pull tab ring 2 so that a finger tip or finger nail may be more easily positioned under pull ring 2 to facilitate manual crown removal.

Figure 10:
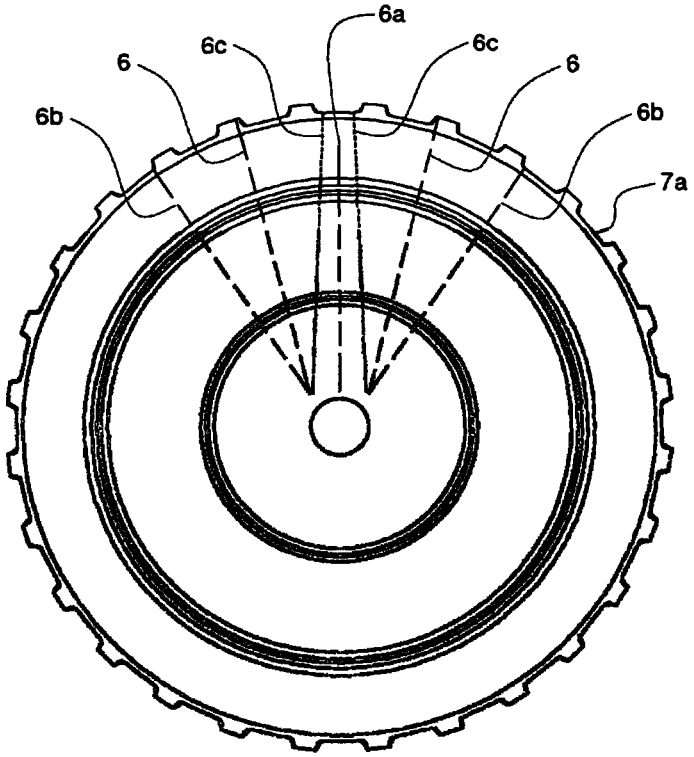
FIG. 10 is a diagrammatic illustration of a top view of a further alternative embodiment of a crown of the present disclosure.

FIG. 10 is a diagrammatic illustration of a top view of a further alternative embodiment of a crown of the present disclosure. Pull tab ring 2, pull tab 3 and rivet 4 are not shown. Cut lines 6 typically diverge toward rim 7*a* from imaginary center line 6*a*. The present disclosure contemplates alternative degrees of divergence 6*b* (dashed lines), for example, or that cut lines 6*c* (dotted lines) may converge toward rim 7*a*. The lines may even be substantially parallel. Convergence or divergence, and the selected degrees or angle separating the lines, is a matter of design choice, as is the number of cut lines, which may be as few as one or even zero. Accordingly, the present invention contemplates all and every permutation of cut lines which may be selected for the engineering design of a particular crown. Additionally, FIG. 10 illustrates an embodiment of the present crown formed to have 28 angles around the circumference of the crown.

Figure 11:
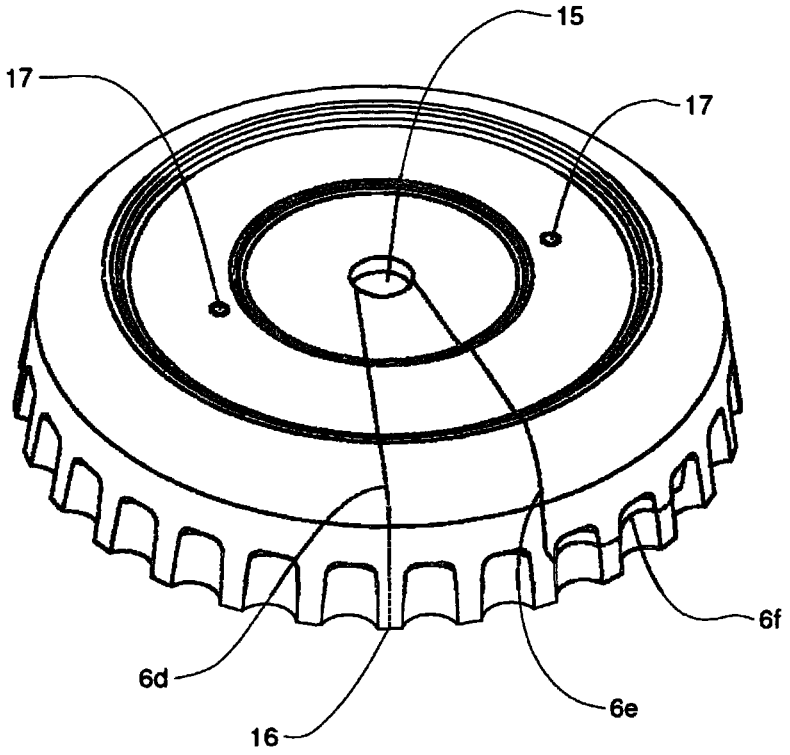
FIG. 11 is a diagrammatic illustration of an isometric top view of an alternative embodiment of a crown of the present disclosure.

FIG. 11 is a diagrammatic illustration of an isometric top view of an alternative embodiment of a crown of the present disclosure. The Easy Pull™ pull tab apparatus is not shown in order to illustrate more plainly the cut lines 6*d* and 6*e*. In a preferred embodiment, one of the cut lines 6*e* provides an S-curve or tail segment 6*f* that extends along the angle portion 7 of crown 1. Portion 7 may also be referred to herein as skirt 7, which descends contiguously from the top of crown 1. Skirt 7 is described in more detail further below in the disclosure. S-curve 6*f* may facilitate the removal of crown 1 from a container opening. In operation, a person tears from center 15 along cut lines 6*d* and 6*e*. When the tear reaches S-curve 6*f*, the tearing force follows the S-curve away from cut line 6*d* and impels the tear along cut line 6*d* to terminus 16 which breaks open crown 1. Continued tearing force along S-curve 6*f* pulls angle portion 7 away from the container opening (not shown) and releases crown 1 from the container (not shown). S-curve 6*f* consists of a scoring line having an upper radial segment extending from the opener assembly to the skirt along a radial axis and a lower annular segment extending circumferentially along the skirt in an annular direction and extending from a terminus of the upper radial segment, the lower annular segment defined in a second horizontal plane equidistant to the first horizontal plane associated with the lower edge of the skirt.

Another feature illustrated in FIG. 11 is one or more spoilage indicators 17 such as dimples depressed in crown 1 and positioned so as not to be obscured by the pull ring apparatus of the present disclosure. For containers that are vacuum sealed, spoilage indicators 17 pop up in the event that the pressure seal is lost.

Figure 12:
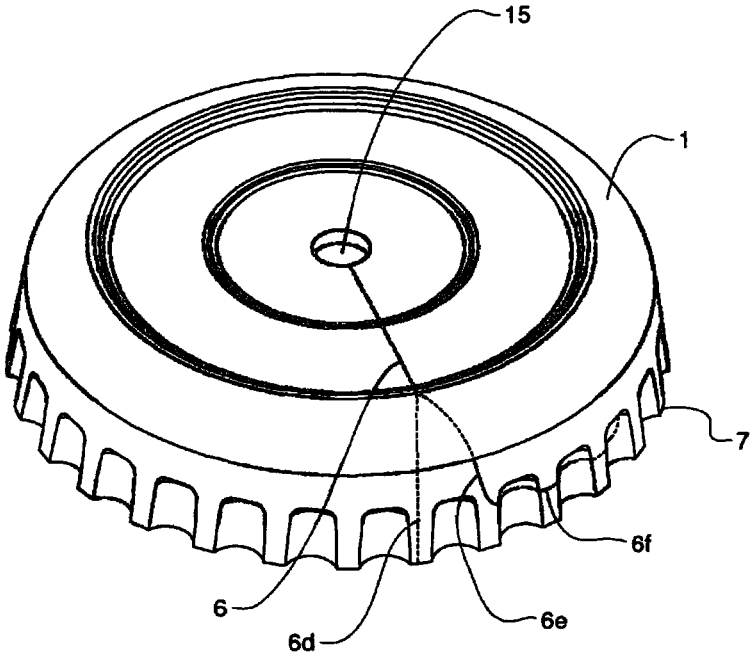
FIG. 12 is a diagrammatic illustration of an isometric top view of an alternative embodiment of a crown of FIG. 11.

FIG. 12 is a diagrammatic illustration of an isometric top view of an alternative embodiment of a crown of FIG. 11. Again, the Easy Pull™ pull tab apparatus is not shown in order to illustrate more plainly the cut lines. The embodiment of FIG. 12 may provide a single cut line 6 extending outward from center 15. Cut line 6 branches or forks in to cut line 6*d* which extends to the edge of crown 1 and cut line 6*e* which curves into S-curve portion 6*f* as described above for FIG. 11.

Figure 13:
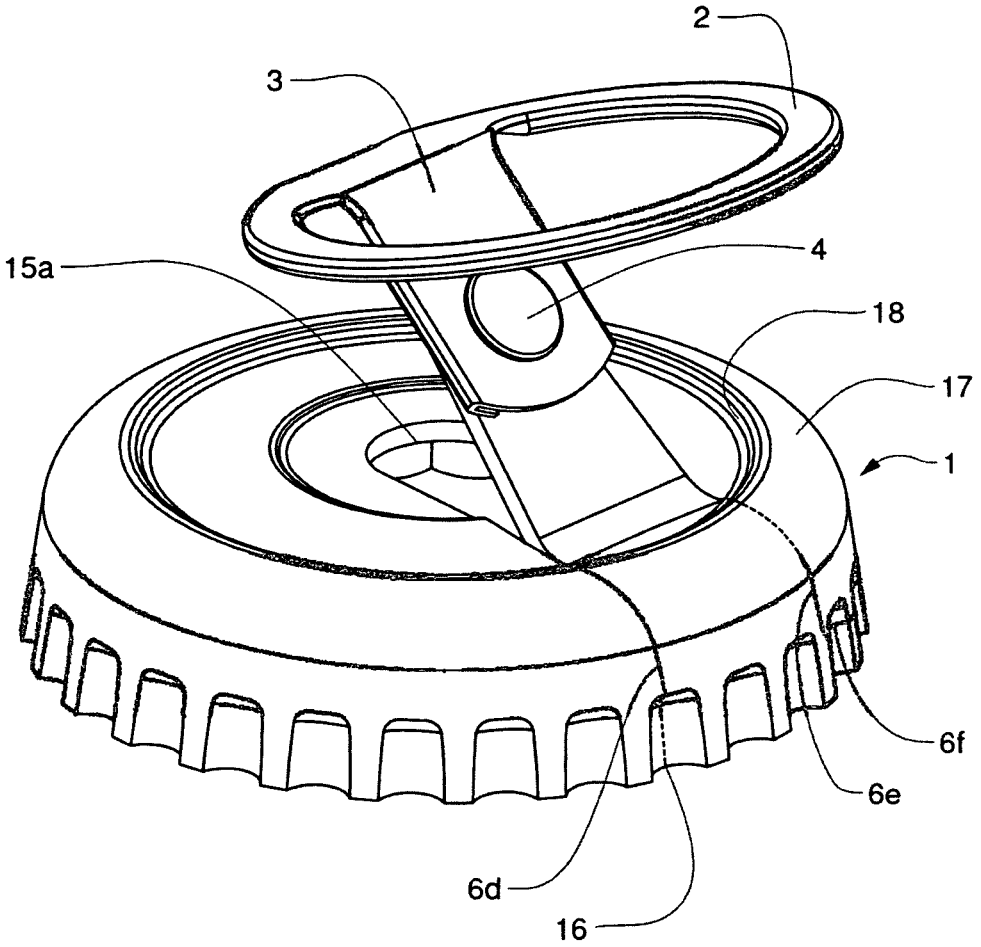
FIG. 13 is a diagrammatic illustration of an isometric top view of an alternative embodiment of a crown of FIG. 11.

FIG. 13 is a diagrammatic illustration of an isometric top view of an alternative embodiment of a crown of FIG. 11. The crown 1 of FIG. 11 is shown popped open in the center 15*a* with pull ring 2. Pull tab 3 is connected to crown 1 with rivet 4 and is in position to tear along cut lines 6*d* and 6*e* with application of manual force. One or more circular depressions 18 create space in the top 17 of crown 1 to seat pull ring 2 and the rest of the opener apparatus.

Figure 14:
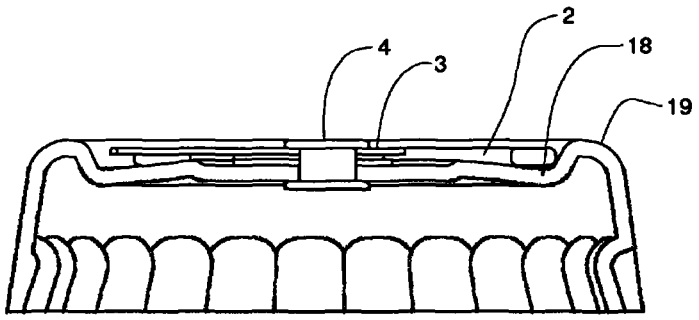
FIG. 14 is a diagrammatic illustration of a side cross sectional view of an alternative embodiment of a crown of FIG. 13.

FIG. 14 is a diagrammatic illustration of a side cross sectional view of an alternative embodiment of a crown of FIG. 13. Skirt 7 descends from shoulder 19 which is contiguous with top 17. Seat 18 is of sufficient depth that pull ring 2 is substantially flush with the top 17 of crown 1. Such an embodiment advantageously is suitable for use in conventional bottle capping machines without having to re-tool or—refit the machine. A further advantage of seat 18 is that seat 18 forms a corrugated perimeter around the seat and corrugation is well known to strengthen flat sheets against bending in directions substantially perpendicular to the direction of corrugation. Seat 18, therefore, provides the additional advantage of strengthening crown 1. A further advantage of a strengthened crown as provided by seat 18 is that the thickness of crown may be reduced to a lower gauge (thinner) crown material than would be utilized in a standard crown, thus lowering the costs of manufacturing materials. Although FIG. 14 shows an embodiment of the present crown formed to have 27 angles in circumference around the crown, it will be understood by those skilled in art that the advantages of seat 18 do not depend on the presence or number of angles.

Figure 15:
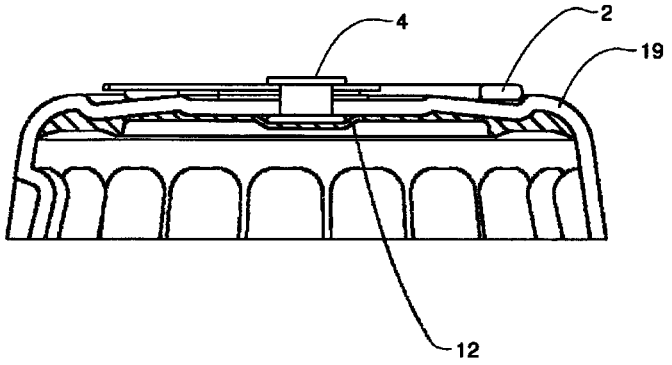
FIG. 15 is a diagrammatic illustration of a side cross sectional view of an alternative embodiment of a crown of FIG. 14.

FIG. 15 is a diagrammatic illustration of a side cross sectional view of an alternative embodiment of a crown of FIG. 14. Seat 18 is shallower than as shown in FIG. 14, so that pull ring 2 is seated slightly or partially above the top 19 of crown 1. Such an embodiment may provide the advantage of having pull ring 2 easily accessible for manual opening. Depending on the acceptable tolerances, such an embodiment may also be suitable for use with a standard bottle capping machine.

FIG. 15 also illustrates an alternative embodiment in which liner 12 is mounted on the under surface of crown 1 with a suitable adhesive and is disposed so as to cover the bottom of rivet 4. Such embodiment may be distinguished from that illustrated in FIG. 9, in which rivet 4 secures liner 12 in position to the underside of crown 1.

Figure 16:
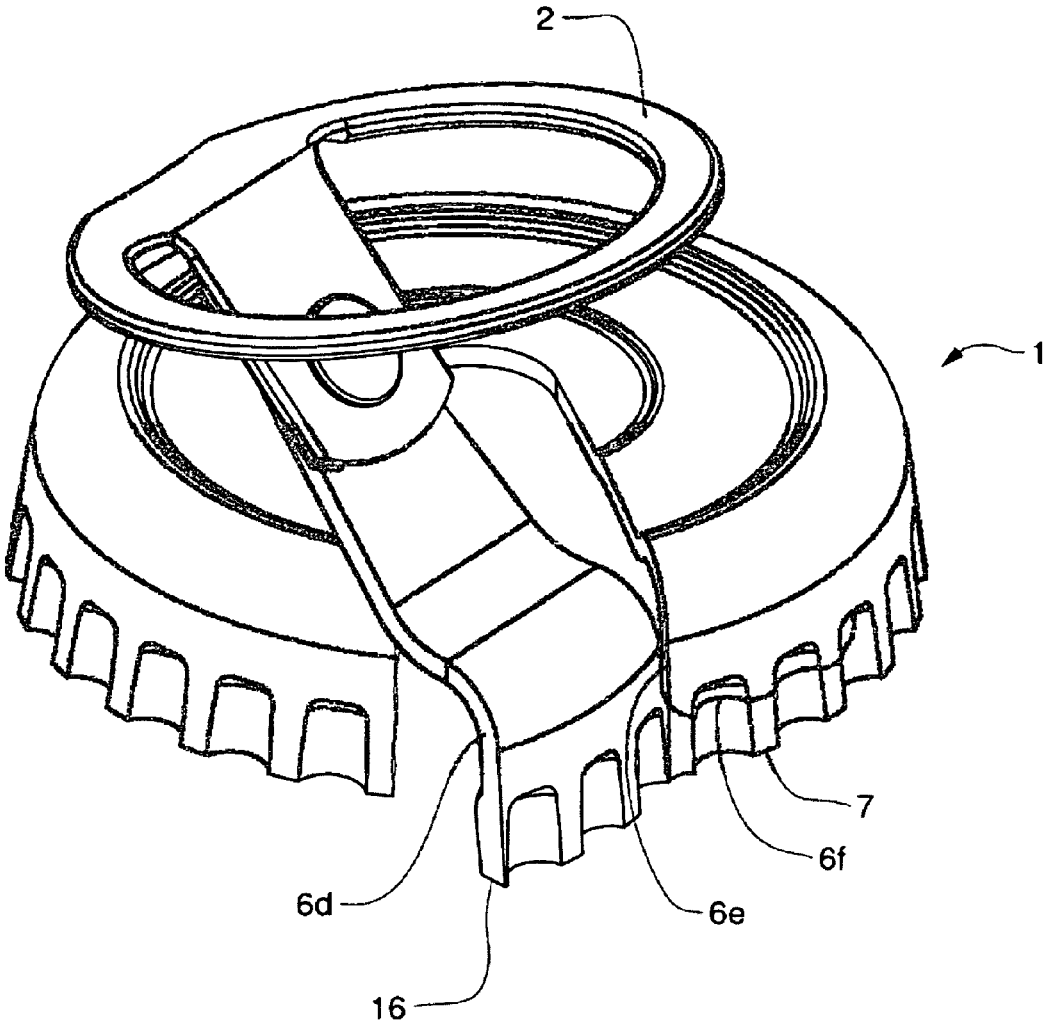
FIG. 16 is a diagrammatic illustration of an isometric top view of an alternative embodiment of a crown of FIG. 13.

FIG. 16 is a diagrammatic illustration of an isometric top view of an alternative embodiment of a crown of FIG. 13. Here, crown 1 is broken open at terminus 16 of cut line 6*d*. Further tearing with pull ring 2 along S-curve 6*f* will liberate a container (not shown) from angles 7 and detach crown 1 from the container.

Figure 17:
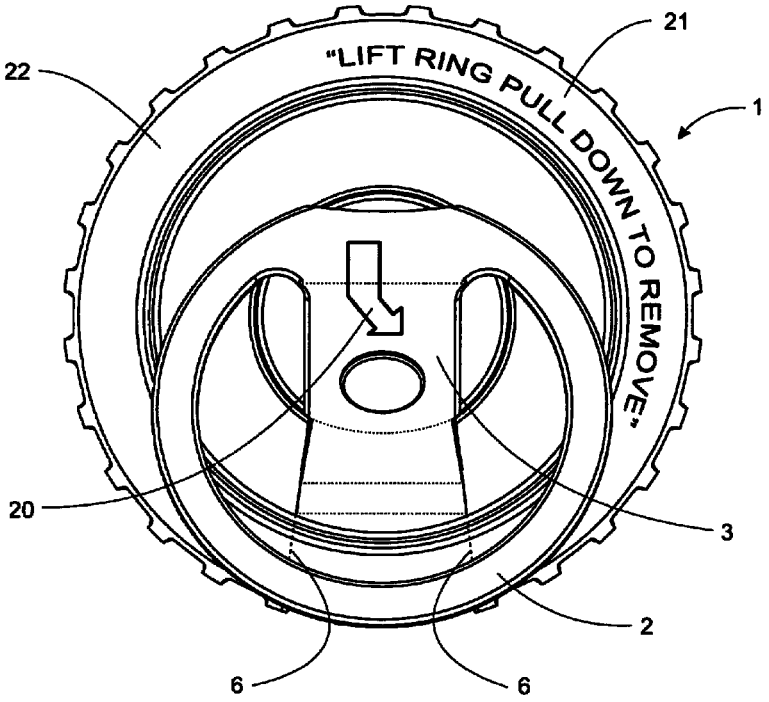
FIG. 17 is a diagrammatic illustration of a top view of an alternative embodiment of a crown of FIG. 13.

FIG. 17 is a diagrammatic illustration of a top view of an alternative embodiment of a crown of FIG. 13. The embodiment of FIG. 17 provides printed matter such as a bent arrow 20 printed on pull tab 3 to indicate generally how a person should pull ring 2 in order to exploit the cut lines 6 for easy opening. Further instructions may be provided with printed instructions 21, which may read, for example: "LIFT RING PULL DOWN TO REMOVE". Additionally a caution warning 22 may be printed on crown 1.

Figure 18A:
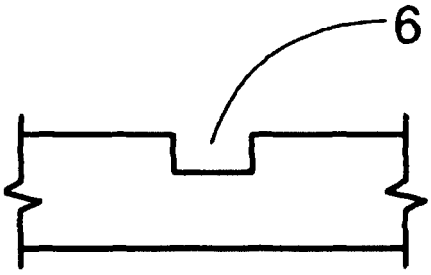
FIG. 18A is a diagrammatic illustration of a side cross section view of an embodiment of a cut line of the present disclosure.

FIG. 18A is a diagrammatic illustration of a side cross section view of an embodiment of a cut line of the present disclosure. To form a tearing groove, cut line 6 may be machined to have any one or more of a variety of cross-sectional profiles, depending on the engineering choice of a particular manufacturer. For instance, FIG. 18A illustrates a square or rectangular cross section profile.

Figure 18B:
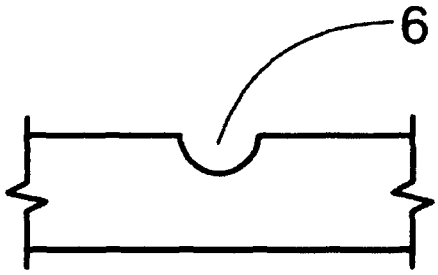
FIG. 18B is a diagrammatic illustration of a side cross section view of an alternative embodiment of a cut line of FIG. 18A.

FIG. 18B is a diagrammatic illustration of a side cross section view of an alternative embodiment of a cut line of FIG. 18A. Here, a curved cross section profile for cut line 16 is illustrated.

Figure 18C:
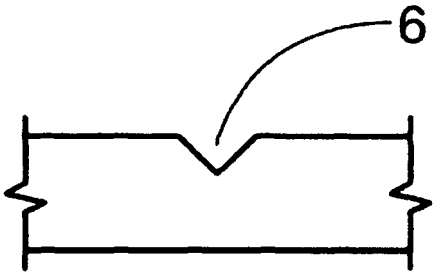
FIG. 18C is a diagrammatic illustration of a side cross section view of an alternative embodiment of a cut line of FIG. 18A.

FIG. 18C is a diagrammatic illustration of a side cross section view of an alternative embodiment of a cut line of FIG. 18A. A V-shaped cross section profile for cut line 6 is illustrated.

Figure 19:
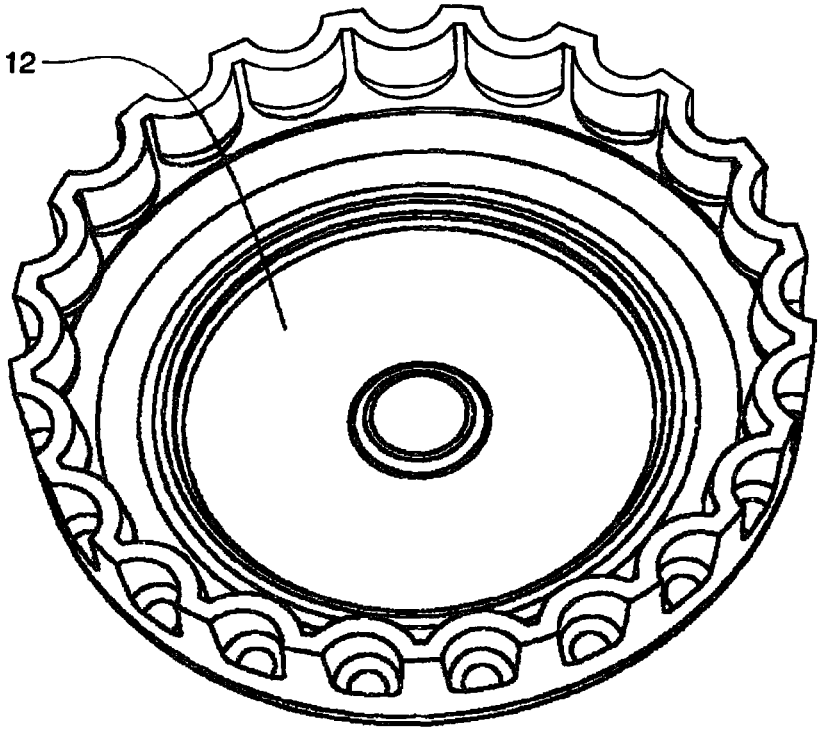
FIG. 19 is a diagrammatic illustration of an isometric view of the bottom of a crown of the present disclosure.
Figure 20A:
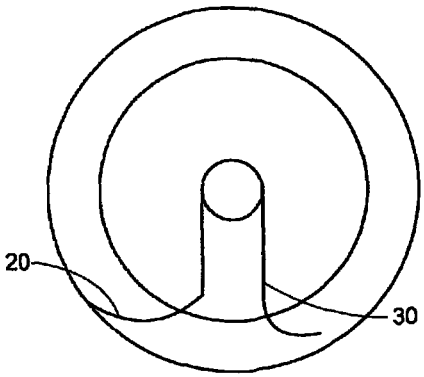
FIGS. 20A-20E are top view schematic illustrations of alternative embodiments of a crown of the present disclosure each embodiment having a curvilinear left score line extending from the center of the top of the crown to the annular edge of the crown.
Figure 20B:
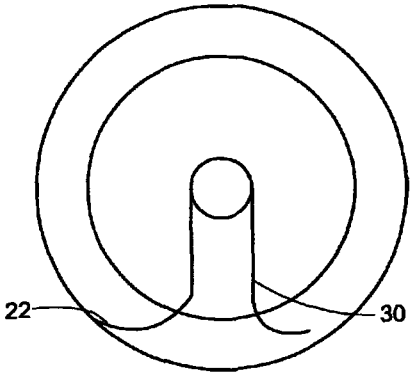
Figure 20C:
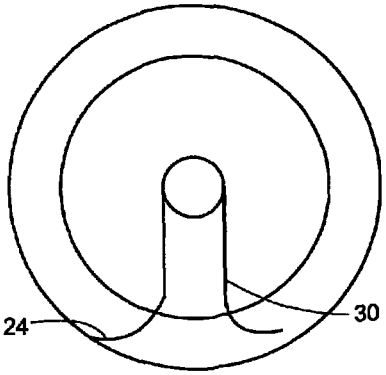
Figure 20D:
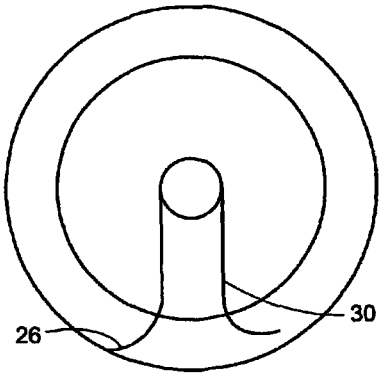
Figure 20E:
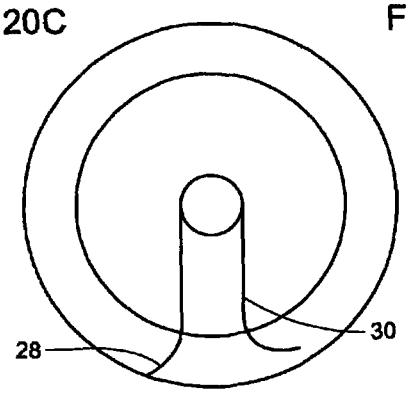

FIG. 19 is a diagrammatic illustration of an isometric view of the bottom of a crown of the present disclosure. Liner 12 adheres to the top of the underside of the crown and is disposed over the bottom of rivet 4. Additionally, FIG. 19 illustrates an embodiment of the present crown formed to have 21 angles in circumference around the edge of the crown.

FIGS. 20A-20E are top view schematic illustrations of alternative embodiments of a crown of the present disclosure each embodiment having a curvilinear left score line extending from the center of the top of the crown to the annular edge of the crown. To reduce the risk of generating sharps from opening a crown of the present disclosure, various alternative embodiments provide score, cut or tear lines that create a gentle curve along the edge of the crown after the pull tab portion has been torn away. Accordingly, alternative cut lines 20, 22, 24, 26, and 28, of FIGS. 20A through 20E, respectively, arc to the left (as seen looking down on the top of the crown) so that when the pull tab portion is torn and pulled away from the crown it leaves behind a gently curving shape along the edge of the crown rather than a sharp. Each embodiment 20A-20E, illustrating curvilinear score lines 20, 22, 24, 26, and 28, has a different degree of curvature one from the next and it is a matter of engineering or design choice as to the amount of curvature selected to obtain the desired performance characteristics. A relatively flat score line 20, for example, yields a smooth edge but might require more force to tear, whereas a relatively more curved score line such as 28, for example, may require less force to tear but yields a differently shaped edge from that of score line 20. Score line 30 arcs to the right and terminates before the edge of the crown so that the crown is preserved as a unitary piece after the crown has been removed from the bottle or whatever container it was sealing.

Figure 21:
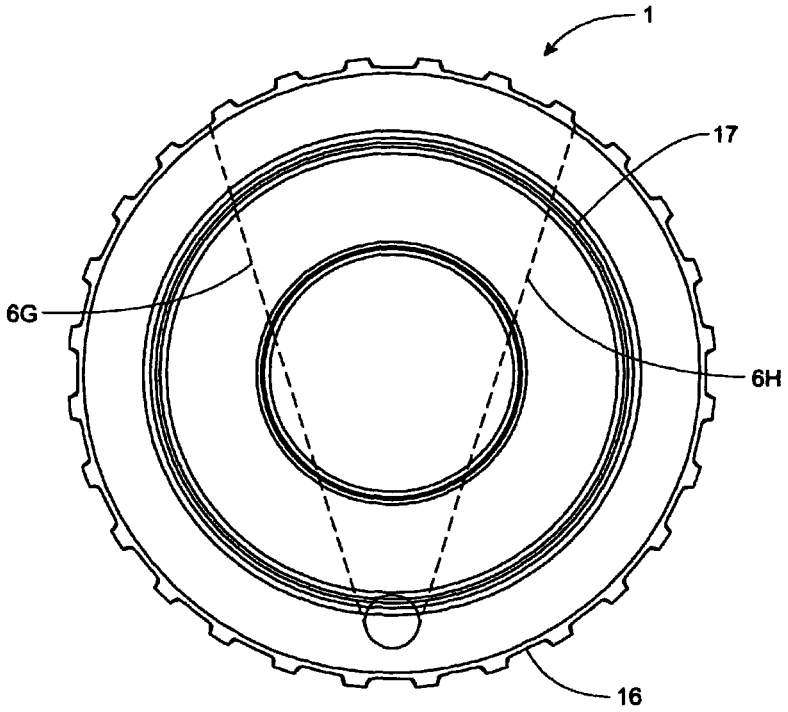
FIG. 21 is a top view schematic representation of an alternative embodiment of a crown of the present disclosure illustrating an off-center location for the pull tab.

FIG. 21 is a top view schematic representation of an alternative embodiment of a crown of the present disclosure illustrating an off-center location for the pull tab. Embodiments of the present crown having an off-center location for rivet 4 and the rest of the opener assembly are advantageous, for example, for non-beverage containers such as containers for canned goods like soup or beans, which familiarly have opener assemblies close to the edge to the container. Tear lines 6G and 6H traverse across top 17 of the crown 1 in a substantially rectilinear fashion to edge 16. Accordingly, the location of rivet hole or rivet 4 or of the crown 1 opener assemble on the top of crown 1 is largely a matter of engineering design choice. A crown of the off-center rivet embodiments is opened as described herein above of the other embodiments.

Figure 22:
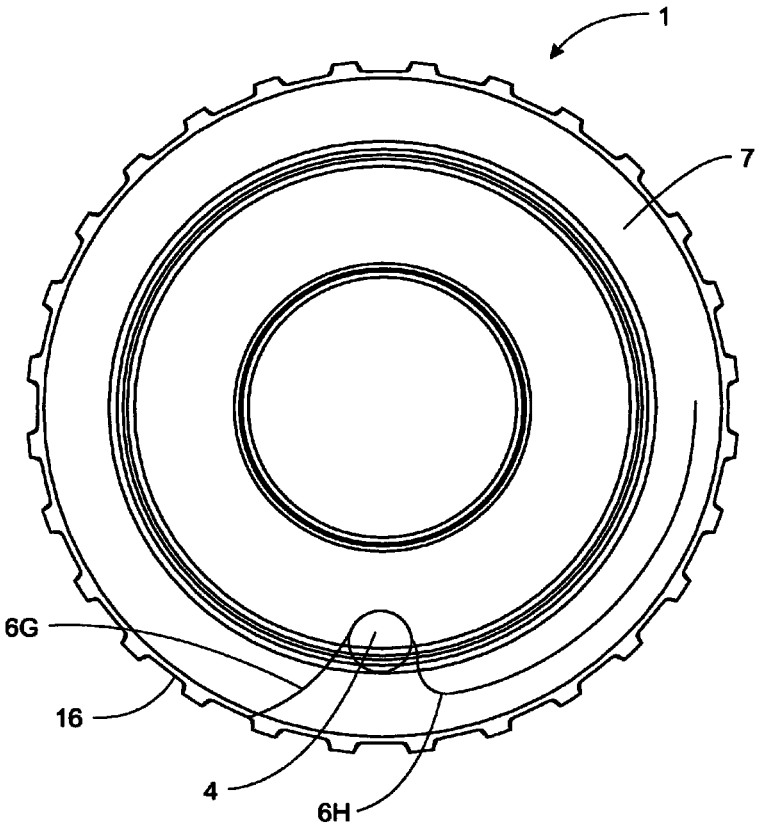
FIG. 22 is a top view schematic representation of an alternative embodiment of the crown of FIG. 21 with an alternative score line.

FIG. 22 is a top view schematic representation of an alternative embodiment of the crown of FIG. 21 with an alternative score line. Scoring lines 6G and 6H in the embodiment of FIG. 22 descend to skirt 7 directly from rivet 4, in contrast to FIG. 21, but similar to lines 6 in the previously described embodiments. Score line 6G descends to edge 16, whereas line 6H trails in the opposite direction maintaining for its length a substantially equal distance from edge 16 and top 7. Scoring line 6H consist of a scoring line having an upper radial segment extending from the opener assembly to skirt 7 along a radial axis and a lower annular segment extending circumferentially along skirt 7 in an annular direction and extending from a terminus of the upper radial segment to an end point substantially spaced from the bottom annular edge 16 of the skirt 7. Preferably the lower annular segment defines a longer horizontal plane than that defined in the S-curve of scoring line 6*f*, described above, extending, for example approximately one quarter of the circumference of skirt 7.

Figure 23:
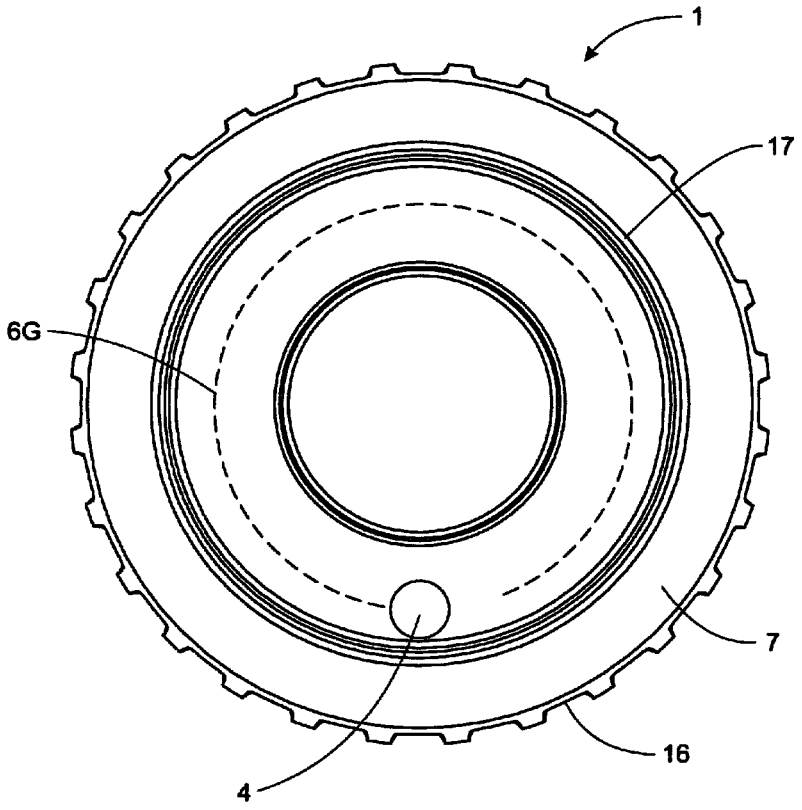
FIG. 23 is a top view schematic representation of an alternative embodiment of the crown of FIG. 21 with another alternative score line.

FIG. 23 is a top view schematic representation of an alternative embodiment of the crown of FIG. 21 with an alternative score line. The score line for tearing crown 1 open circumscribes an almost complete circle around top 17 only to descend into skirt 7 at the end and all the way to crown edge 16. The embodiment of FIG. 23 is advantageous, for example, when employed with containers for products other than a beverage, such as soup or stew, where a large mouth opening provides easy access to the contents.

Figure 24:
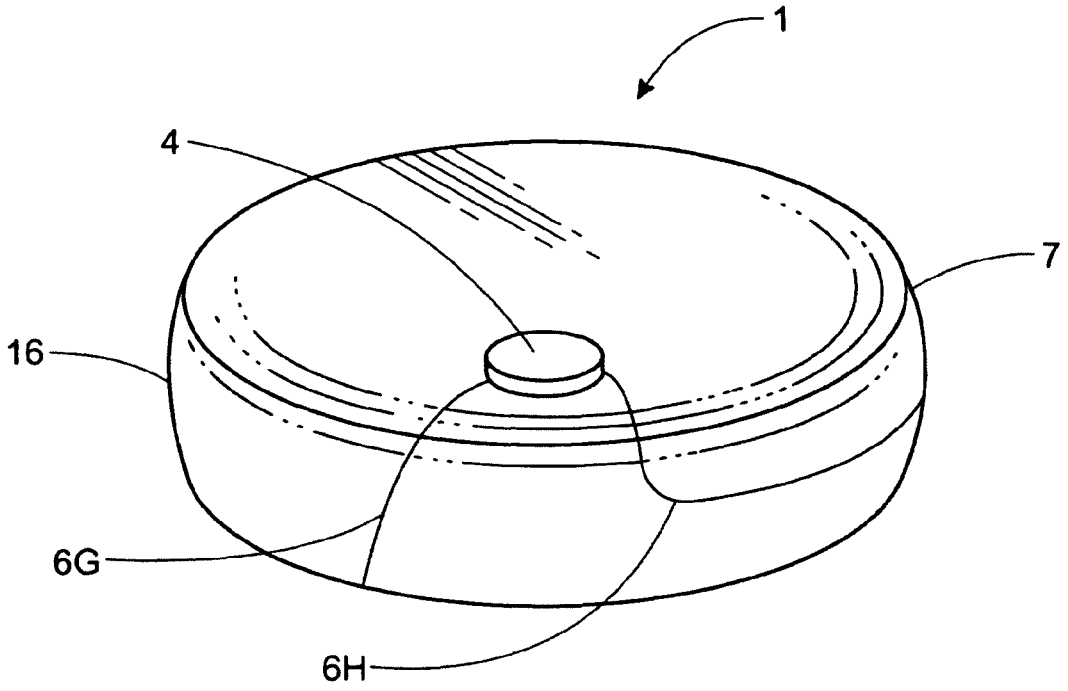
FIG. 24 is an isometric view schematic representation of an alternative embodiment of a crown of the present disclosure having no crimping angles.

FIG. 24 is an isometric view schematic representation of an alternative embodiment of a crown of the present disclosure having no crimping angles. A crown of the embodiment of FIG. 24 is comparable to pressure-sealed crowns for fruit juices and the like which curl over the top of a container without crimping. The embodiment is also advantageous for use with medical containers and vials. The opener assembly with rivet 4 is off-center, but otherwise crown 1 opens as previously described.

Figure 25A:
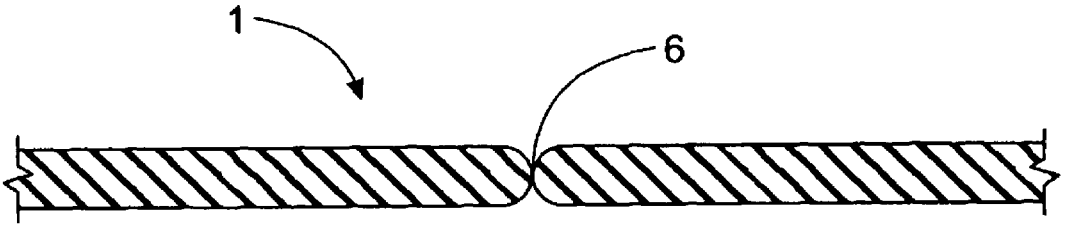
FIG. 25A is a cross-section schematic illustration of an unbroken score line of a crown of the present disclosure.
Figure 25B:
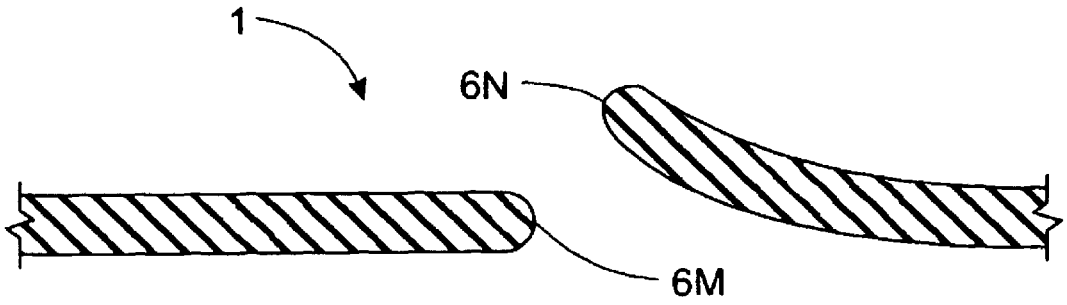
FIG. 25B is a cross-section schematic illustration of a broken score line of the embodiment of FIG. 24A.

FIG. 25A is a cross-section schematic illustration of an unbroken score line of a crown of the present disclosure. FIG. 25B is a cross-section schematic illustration of a broken score line of the embodiment of FIG. 25A. An advantageous safety feature of a crown of the present disclosure is achieved in the manufacture of score lines 6. Describing FIGS. 25A and 25B together, line 6 is scored on crown 1 in such a way that the moieties on either side of line 6 have curved edges 6M and 6N in cross-section profile. The seal formed by line 6 may be analogized to the seal formed by pressing the fingers of opposing hands together. The tip of each finger is curved and when two fingers are brought together, a seal can be formed. When score line 6 in FIG. 25A is torn as one opens crown 1 using the present opener assembly, crown 1 forms two edges 6M and 6N, which are curved or rounded, analogous to pulling the fingers apart. Non-sharp edges 6M and 6N, respectively, are formed upon breaking the frangible scoring line 6.

The reason score line 6 of FIGS. 25A and 25B is advantageous is that it reduces the sharps produced by tearing open crown 1 with the opener assembly. Round tear edges 6M and 6N render the opened crown dramatically less dangerous from sharps than would otherwise be the case.

Further regarding score line 6, one consideration of a crown of the present disclosure is the ease with which the material of crown 1 can be torn once opened by the opener assembly. The ease of tearing relates to the amount of pull force that needs to be applied to tear the crown material. Pulling force may be reduced, that is, ease of tearing may be increased, with the use of crown coatings or lacquers known in the art that contain additives which increase the ease of tearing, by reducing the required pull force, of the crown 1 material along line 6. Specific embodiments may also include degradable plastic additives for the liner attached to the underside of the crown to facilitate biodegradation of the liner after a used crown has been disposed of as waste. A variety of commercially available bio-degradable plastic additives are known in the art and the selection of one or more such additives is a matter of design choice.

In addition to the various structures described herein, certain advantages over the prior art are bestowed on the present crown by the recommended specifications shown in Table 1.

TABLE 1

| Items | Acceptable Range/Target |
|---|---|
| 1. Appearance | Disc properly adhering<br>White, clear or color pigmented liner<br>Complete liner<br>Clean liner<br>Clean crown and ring<br>No rust and scratch for crown and ring<br>Two cut lines on the downward surface of crown<br>Rivet<br>Crown |
| 2. Dimensions | Thickness (mm): 0.12-0.28<br>Inside diameter (mm): 32.08-32.12 |

TABLE 1-continued

| Items | Acceptable Range/Target |
|---|---|
| | Outside diameter (mm): 26.60-26.90<br>Radius of angle (mm): 1.5-1.9<br>Number of angels: 21-32<br>Ring |
| | Diameter (mm): 21.1-21.5<br>Thickness (mm): 0.28-0.32<br>Liner |
| | Diameter (mm): 20.00-20.50 |
| 3. Rockwell Hardness | T4 on the Rockwell 30T scale |
| 4. Secure Seal | Greater than/equal to 150 PSI for 1 minute |
| 5. Finish Hardness | Should not scratch with "H" pencil |
| 6. Sensory | No significant differences with an identified control after 12 weeks at 20 degrees C. |
| 7. Lubricant Migration | No particles or lubricant should be present |
| 8. Simulated Palletizing | CO2 loss should not differ against control caps when stored for 1 week with max weight of 45 Kgs over each bottle |
| 9. Corrosion | Maximum corrosion: slight to moderate |
| 10. Odor | No off odors detected |
| 11. Pulling Force of Ring (kg) | less than or equal to 2.5 kg |
| 12. Composition of Material | Tinplate crown and ring; food class non-PVC for liner |
| 13. Package | 10000 crowns per box |
| 14. Pressure (kg) | 10 kg |
| 15. Container 40' Loading | 1,247 Master Cartons |
| 16. Printing | Logo/other design may be printed on the Easy Pull ™ Cap |
| 17. Crown Anti-Oxidation | Material used is "food grade" PET; clear, with no odor, 1.2 UM (micrometers) |

In particular, a tinplate material which demonstrates an approximate hardness of T-4 on the Rockwell 30T Hardness Scale is preferred for the present cap (see item 3 in table 1), although embodiments of T-3 and T-5 are advantageous for particular products. The preferred soft tinplate material requires less force to open and tear with the opener assembly of the present crown while still providing sufficient sealing of the container contents. For the purposes of this disclosure, tinplate refers the any material, including tin or tin alloys, from which a crown may be fabricated and does not necessarily mean that the crown is made from tin or a tin alloy.

A pulling force for a pull ring of the present disclosure of approximately 2.5 kg (kilograms) or less is preferred (see item 11 of Table 1). A relatively small pull force such as this is recommended so that virtually everyone will have sufficient strength to open a bottle using a crown of the present disclosure. In contrast, a relatively large pull force has the disadvantage of requiring a great amount of initial force to tear the tinplate material, and once the tinplate is torn open the sudden release of pulling force causes the bottle to jerk away from the user, spilling the contents often in dramatic fashion.

In addition to the low hardness of the tinplate, the thinness or gauge of the crown may also contribute to achieving a small pull force. For example, a crown of the present invention is recommended to have a thickness of less than 0.28 mm (see item 2 in Table 1). Typical bottle crowns have a thickness of 0.28 mm or greater. Embodiments in which the crown material is strengthened by corrugation, such as in seated embodiments, may be thinner than standard crowns, having, for example, a gauge as thin as approximately 0.16 mm.

In addition to the foregoing embodiments described above, an additional embodiment provides a reduced gauge crown that delivers additional advantages.

Billions of bottle caps are used worldwide and the cost of the caps is largely determined by the amount of material required for the caps. One way to reduced such costs is to reduce the amount of material used in each crown. The amount of material can be reduced by making the crown thin, or reducing the gauge of the crown. A reduced gauge could be achieved by using less material but this might compromise the integrity of the crown by making the crown weaker. Another approach would be to use less material but use a stronger material. However, stronger materials might be more expensive than standard tin plate typically used in crown manufacture, which would defeat the cost savings purpose. An approach that reduces the amount of material but uses the same material without compromising strength is to corrugate the crown. Such corrugation is described herein in regards to FIG. 13, for example, which describes the present crown having a seat formed in the top to receive the opener assembly. The following is a description of a low gauge embodiment of the present crown in which the advantages of corrugation are exploited.

Figure 26:
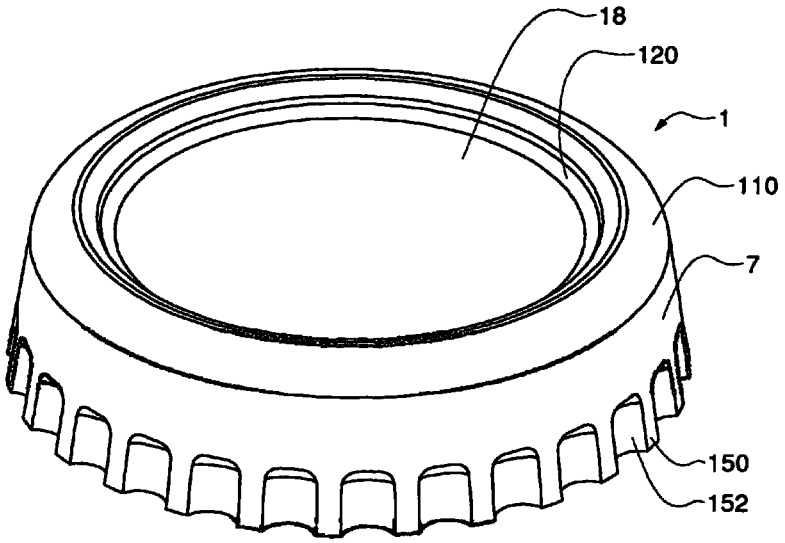
FIG. 26 is an isometric side view illustration of a reduced gauge crown of the present invention.
Figure 27A:
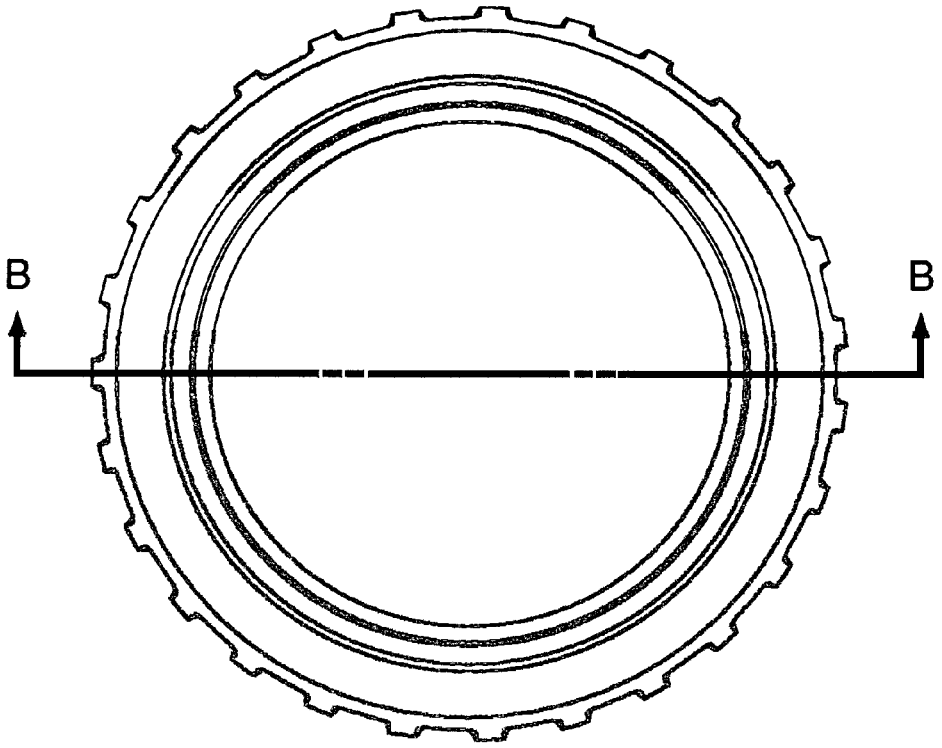
FIG. 27A is a top view illustration of the crown of FIG. 26.
Figure 27B:
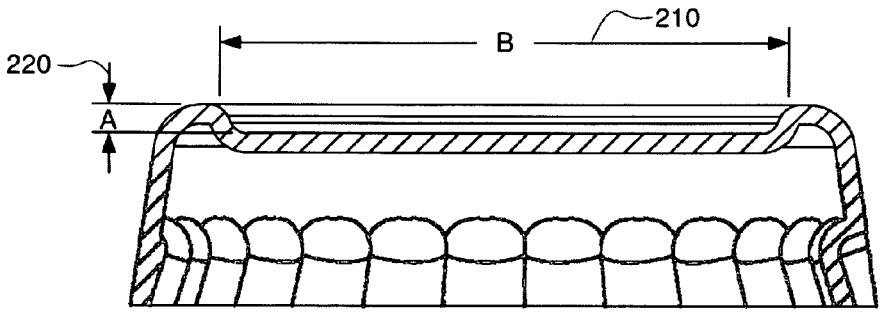
FIG. 27B is a side cross-section view of the crown of FIG. 27A.
Figure 28A:
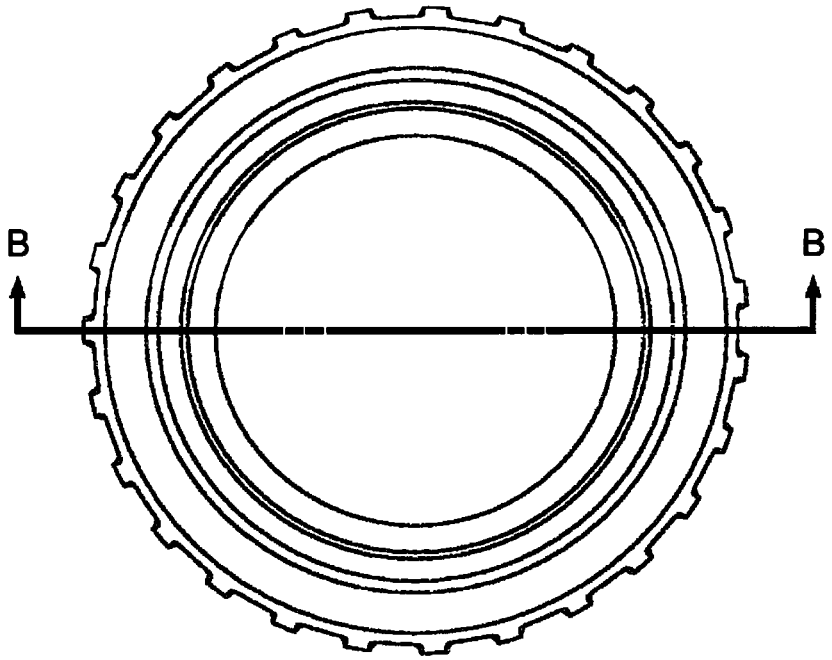
FIG. 28A is a top view illustration of an alternative embodiment of a crown of the present disclosure.
Figure 28B:
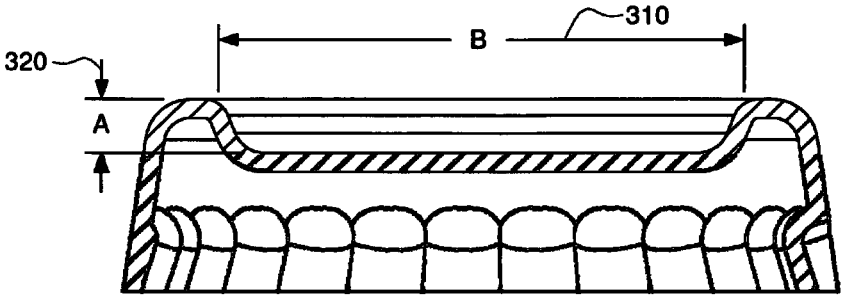
FIG. 28B is a side cross-section view of the crown of FIG. 28A.
Figure 29A:
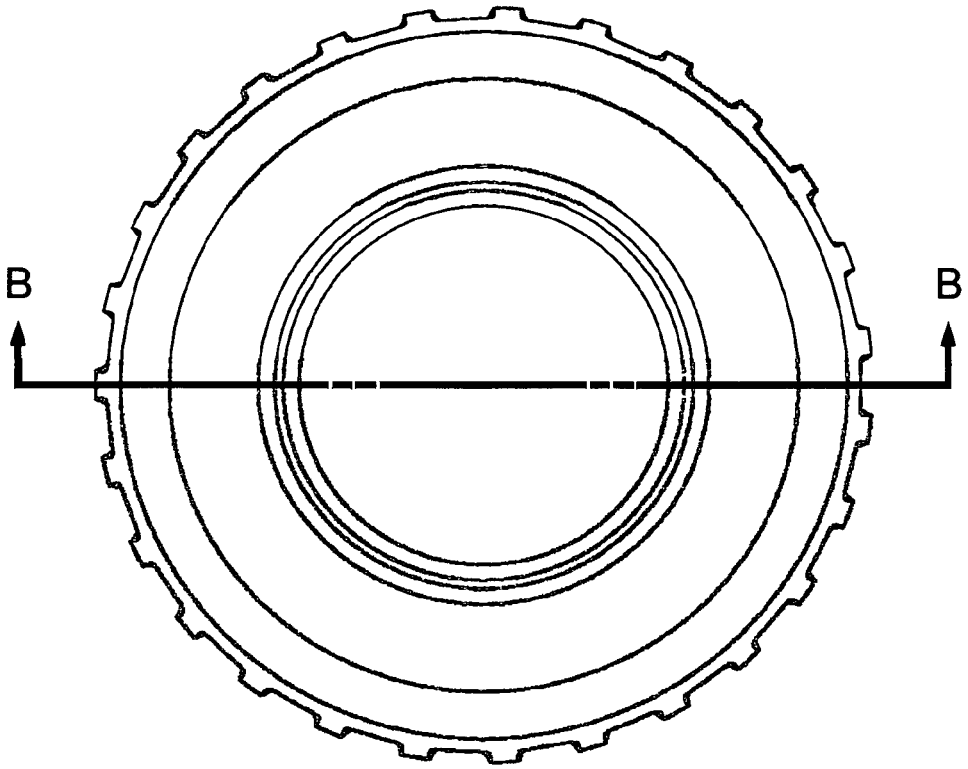
FIG. 29A is a top view illustration of another alternative embodiment of a crown of the present disclosure.
Figure 29B:
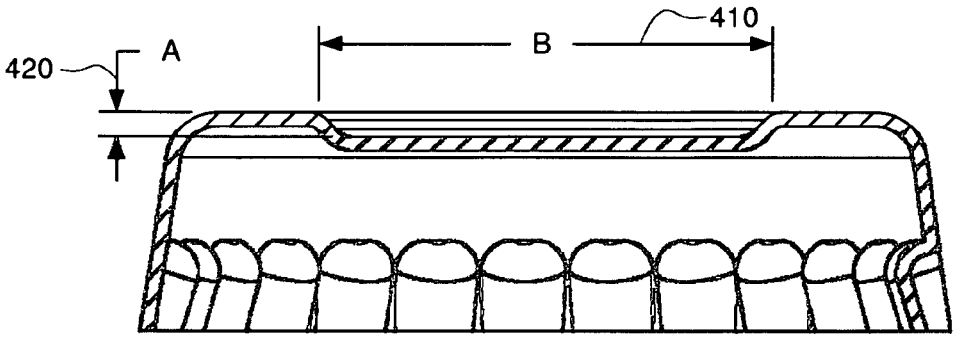
FIG. 29B is a side cross-section view of the crown of FIG. 29A.

Turning now to FIG. 26, Crown 1 includes top portion 110 contiguous with recess 120 which terminates in seat 18. Skirt 7 downwardly extends from top 110. In some specific embodiments a flange extends obliquely from skirt 7. Alternating flutes 150 and lands 152 are formed on a circumferential portion of skirt 7. Crown 1, and other crowns shown in the figures, is shown as a pry-off type that is opened with a lever. The present invention also encompasses a twist-off type (not shown in the figures) that is opened by twisting, as will be understood by persons familiar with crown cap technology. Finally, crown 1 is suitable for use with pull tab type assemblies mounted to seat 130 with effective score lines embossed on crown 100, as described above.

Seat 18 is recessed, that is, it is lower than top 110 but is contiguous with top 110 by virtue of transition surface 120, which will be referred to herein for convenience as recess 120. Recess 120 may formed in crown 1 in a variety of suitable ways to provide advantageous shapes. For example, in specific exemplary embodiments concentric tiers, grooves or steps are integrally formed in the crown 1 material until the desired depth of seat 18 is obtained, as illustrated in FIG. 26. In alternative embodiments, recess 120 is formed with a smoothly curved surface from top 110 to seat 18. The form of recess 120 functions as ribs or structural reinforcements that, it is surmised, help to stiffen seat 18 against deflection or deformation.

Skirt 7 descends from top 110 along the external perimeter of crown 1 and in specific exemplary embodiments smoothly merges into a downwardly and radially outwardly extending flange. The skirt 7 is preferably adapted to be crimped onto the neck of a bottle for sealing. Specific exemplary embodiments of skirt 7 are divided into undulating, repeating portions that define the flutes 150 and lands 152. Preferably, the repeating portions are circumferentially evenly spaced apart such that each flute 150 is identical to all other flutes 150 around the circumference of the crown cap 1, and each land 152 is identical to all other lands 152 around the circumference of the crown cap 1. It should be understood that the crown cap 1 may include any number of flutes 150 and lands 152.

Referring to now to FIGS. 27A and 27B, 28A and 28B and 29A and 29B, the "B" figure of each depicted embodiment is the horizontal cross section of its "A" counterpart through line B-B. Each embodiment, designated 27A/B, 28A/B and 29A/B, is characterized by a particular diameter of its seat 18, as represented by width B 210, 310 and 410 of each embodiment, respectively, and depth A of recess 120 represented by depths 220, 320 and 420, respectively.

A specific amount of material strengthening from corrugation is achieved by selecting an embodiment with a particular combination of seat diameter 210, 310 or 410, for example, and recess depth 220, 320 or 420, for example. Exemplary embodiment 27A/B, for instance, has seat diameter 210, which is relatively wide, and recess depth 220, which is intermediately deep. Exemplary embodiment 28A/B has seat width 310, which is of intermediate width, and recess depth 320, which is the deepest of the three exemplary embodiments. Exemplary embodiment 29A/B has seat diameter 410, which is the narrowest of the embodiments, and recess depth 420, which is the shallowest depth of the three embodiments. To obtain a desired amount of material strengthening from corrugation, a combination of seat width 210, 310, or 410, for example, and recess depth 220, 320 or 420, for example, is selected to achieve a specific embodiment.

Corrugation strengthens materials. This is particularly true of laminar materials formed into a sheet or plane. A laminar product can use less of a material if the material is corrugated provide lateral strength. A bottle cap is a laminar product in which the sheet material, often steel or tin plate, is shaped to be affixed to the top of a bottle or other container. A standard pry-off or twist off cap has a thickness of material that is predominantly determined by considerations of leak prevention and the secureness of the attachment of the cap to the container.

Corrugation allows caps that use less material to have the equivalent strength of a standard thick crown. A corrugated crown is thinner, that is, it has a reduced gauge, in comparison to a standard bottle cap. An advantage of a reduced gauge cap is the money savings obtained by using less material.

Another advantage of a reduced gauge corrugated cap comes into play with innovated "pull-off" caps, which have a pull tab assembly attached to the crown as described herein above. The pull tab breaks the cap material and the crown is torn off the bottle using the pull tab ring of an opener assembly. A reduced gauge cap facilitates the tear off because the cap material is thin and the tearing action is parallel to the direction of material strengthening provided by the corrugation and therefor the tearing force does not have to overcome the material strengthening of the corrugation. Corrugation affords material strengthening perpendicular to the direction of corrugation.

In addition to the structures illustrated in the figures herein, it is understood that other structures will imbue a cap of the present disclosure with the advantages of corrugation and provide a reduced gauge crown for a bottle. For instance, concentric rings, which progress from the top of the skirt toward the center of the seat, and decorative shapes such as stars, brand logos, sports team logos, religious insignia, and the like, formed in the plane of the cap, are embraced in the present disclosure.

Corrugation forms may be provided to a bottle cap by a variety means, including without limitation, metal stamping, pressing, embossing and so forth. Non-metal crowns of the present disclosure may be formed by injection molding for plastic crowns, or by other suitable means of production.

Specific embodiments of the corrugated crown caps described herein, such as embodiments for pry-off or twist off, are formed with steel of increased hardness compared with conventional crown caps presently in commercial production. For example, conventional crown caps are often formed of single reduced, T4, tinplate having a thickness of from 0.21 mm to 0.23 mm. Such tinplate has an average hardness (that is, the reported hardness value regardless of +/− variations) of approximately 61 on a 30T hardness scale, in accordance with ASTM 623. Crown caps 1 described herein may be made thinner and lighter weight compared with the prior art, for example, crown caps 1 may be formed of a material having a thickness of about 0.16 mm to 0.18 mm that have the same or roughly equal performance as conventional, thicker caps. These decreases in metal usage are more easily achieved when the structure of crown caps 1 are made with steel having increased hardness. For example, the inventor has demonstrated the effectiveness of low gauge crowns having grooves using DR8 (according to ASTM 623) or DR550 (according to EN10203). Optionally, the inventor surmises that other materials may be used, such as single reduced tinplate or like material having enhance tempering, tin-free steel having similar properties as those described herein, and the like.

The crown caps 1 preferably have an average hardness of greater than 62 on the 30T scale (conforming to ASTM 623), more preferably greater than about 65, more preferably greater than about 68, more preferably greater than about 71. The embodiments shown in FIG. 26 and FIG. 28A were demonstrated to be effective using steel having a hardness of 73. The upper limit of hardness is set by the maximum stress acceptable to the glass bottle during the crimping process or the spring back (which may tend to urge the crimped flanges toward an uncrimped state) associated with harder plate.

The crown caps 1 may be formed with conventional press equipment, with only minor changes to parts of the tooling to form the structure (such as the grooves, crosses, stars, and dimples). And crown caps 1 may be crimped with conventional equipment, only modified to have a smaller throat compared with existing, conventional crimpers.

Because hardness has a relationship to strength as reflected in the yield point, the aspect of the hardness of the crown may be expressed in yield point on a corresponding scale. For example, DR8 or DR550 tinplate may has a yield point (in a tensile test) of 550 MPA.

However, it will be understood that for pull tab opener embodiments, softer materials, such as softer tinplate than T4 or even aluminum, are advantageous because they facilitate ease of opening and tearing. The strength provided by corrugation permits the use of a relatively soft crown material while preserving the strength required for secure closure of the container. The inventor believes that the most advantageous crown cap embodiment has a combination of strength for secure closure and softness for ease of opening and tearing that is a matter of design and engineering choice. A crown of the present disclosure encompasses crown caps that do not have all of the structure, materials, and/or advantages in this specification.

According to this description, commercially acceptable crown caps formed according to the present disclosure can be commercially made with up to 25 percent less material (e.g., steel or tinplate) compared with many conventional crown caps, which has corresponding advantages in carbon emissions. The savings in material weight are approximately proportionate to the reduction in metal thickness. Further, even though energy required to cool an individual crown is tiny, the energy required to cool the total number of crowns produced each year (approximately 45 billion in North America and approximately 300 billion throughout the world), and the corresponding reduction in that energy, is significant.

The Reduced Gauge Crown has an impact on reducing the cost of the tinplate or steel, and the PVC/PVC free liner material, which is available with an additive, making both the metal crown and PVC or PVC free liner, biodegradable in an "active landfill".

With the resulting lower production and weight in transportation costs in the RGC, in turn, reduce CO2 emissions.

Tinplate or steel used to produce crowns for the beer or soda industry varies between 0.21 mm-0.24 mm. The present reduced gauge crown may use a thickness of between 0.17 mm-0.19 mm. A standard pry-off or twist-off crown, weighs approximately 2.38 grams, whereas the reduced gauge crown weighs approximately 2.14 grams, a 10% reduction in weight yielding a savings in material costs.

A further benefit of the reduced gauge crown is seen in the transportation costs of crowns. A reduction in weight relates to a savings in transportation fuel costs, wear and tear on the transportation vehicles, and reduced transportation carbon dioxide emissions. Standard bottle crowns are traditionally packed 10,000 per carton, as indicated in Table 1, but with the reduced gauge crown embodiment of the present crown, a carton holds 11,000 crowns, thus providing reduced energy, transportation, and carbon dioxide emissions.

Advantages of the reduced gauge crown embodiment include, without limitation, cost savings in production, lower price per crown, lower transportation costs, lower loading costs, as well as reduced carbon dioxide emissions.

In addition to all of the embodiments described herein above, an additional feature is suitable for use with of each of the embodiments as a matter of engineering, design or marketing choice, which is the employment of temperature-sensitive color-changing ink, so-called thermochromic ink, such as described, for example, in U.S. Pat. No. 6,634,516 to Carballido, which is incorporated herein by reference in its entirety. Such thermochromic inks have the property of changing color so as to be one color at room temperature (approximately 21° C.) and a different color when refrigerated to, for example standard retail refrigeration temperature of 4° C. In an exemplary application, the ink is transparent, for example, at room temperature but becomes relatively opaque and visible at chilled temperature, such that a customer has visual confirmation of the approximate temperature without touching the container.

Returning now to the figures, the present disclosure contemplates a variety of alternative exemplary embodiments with respect to the arrangement of score lines in relation to the placement of the opener assembly. FIGS. 30-33 are top view schematic diagrammatic illustrations of exemplary embodiments of a crown of the present disclosure having the opener assembly placed substantially in the center of the top of the crown. FIGS. 34-37 are top view schematic diagrammatic illustrations of exemplary embodiments of a crown of the present disclosure having the opener assembly placed off-center from the top of the crown.

Figure 30:
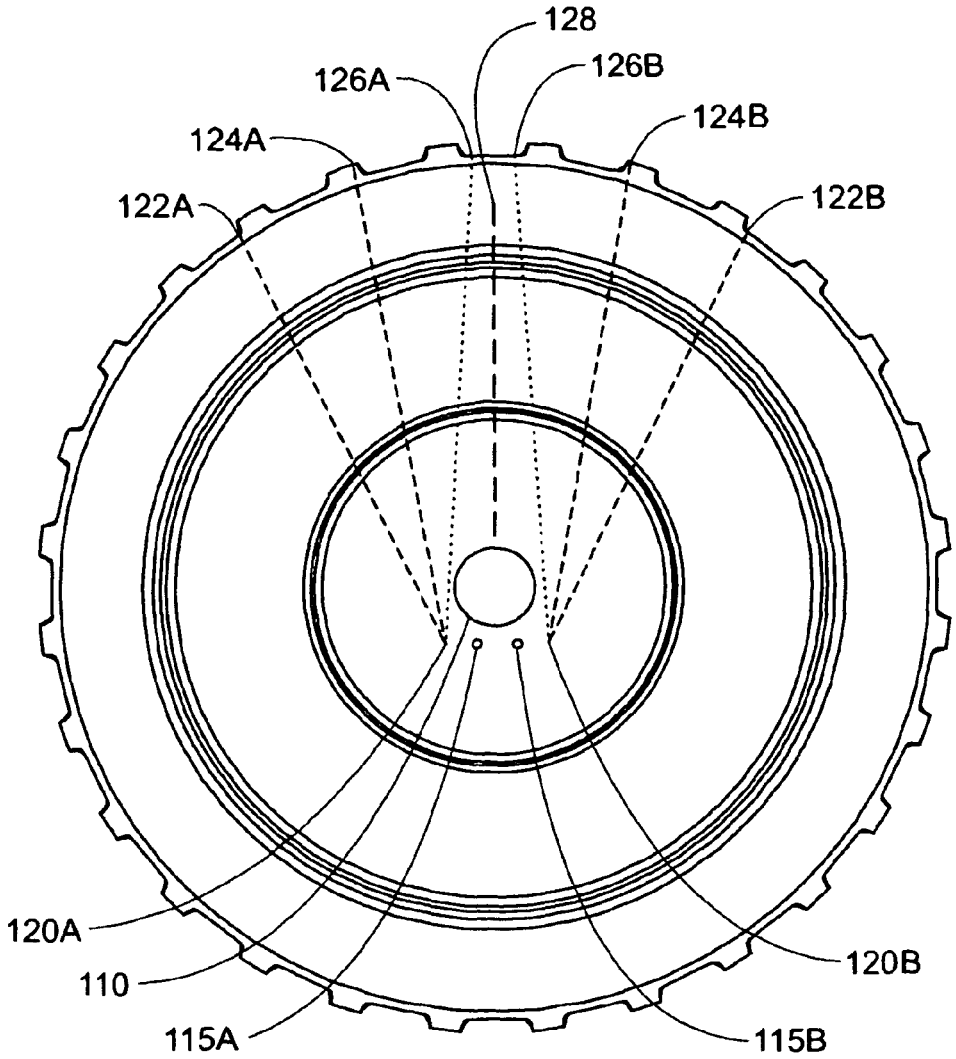
FIG. 30 is a top view schematic diagrammatic illustration of an exemplary embodiment of a crown of the present disclosure having the opener assembly placed substantially in the center of the top of the crown.

Turning to FIG. 30, the opener assembly placement portion is depicted by the circle 110. Dimples 115A and 115B are located, in relation to circle 110, at a position defined as below circle 110. Frangible score lines 120A, 122A, 124A and 120B, 122B, 124B radiate from apexes 120A/B, respectively, proximate to the opener assembly placement portion 110 and provide a frangible scoring line arrangement. Apexes 120/AB are substantially co-linear with embossed dimples 115A/B. Depending on a particular engineering design choice, dimples 115A/B described herein are concave or convex in specific embodiments.

Figure 31:
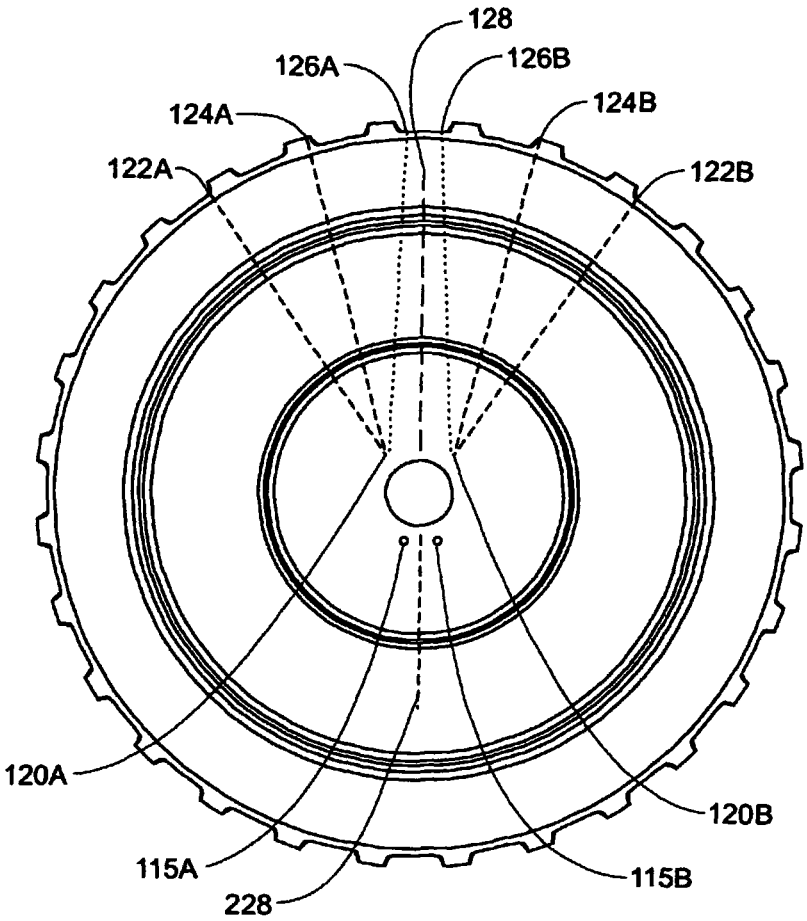
FIG. 31 is a top view schematic diagrammatic illustration of an alternative exemplary embodiment of a crown of the present disclosure having the opener assembly placed substantially in the center of the top of the crown.

FIG. 31 illustrates an alternative exemplary embodiment in which score line apexes 220A/B are at a position defined as being above dimples 115A/B, and substantially parallel to the imaginary line formed by dimples 115A/B. Bottom score line 228 extends from approximately between dimples 115A/B to a terminus that does not extend to the annular skirt of the crown.

Figure 32:
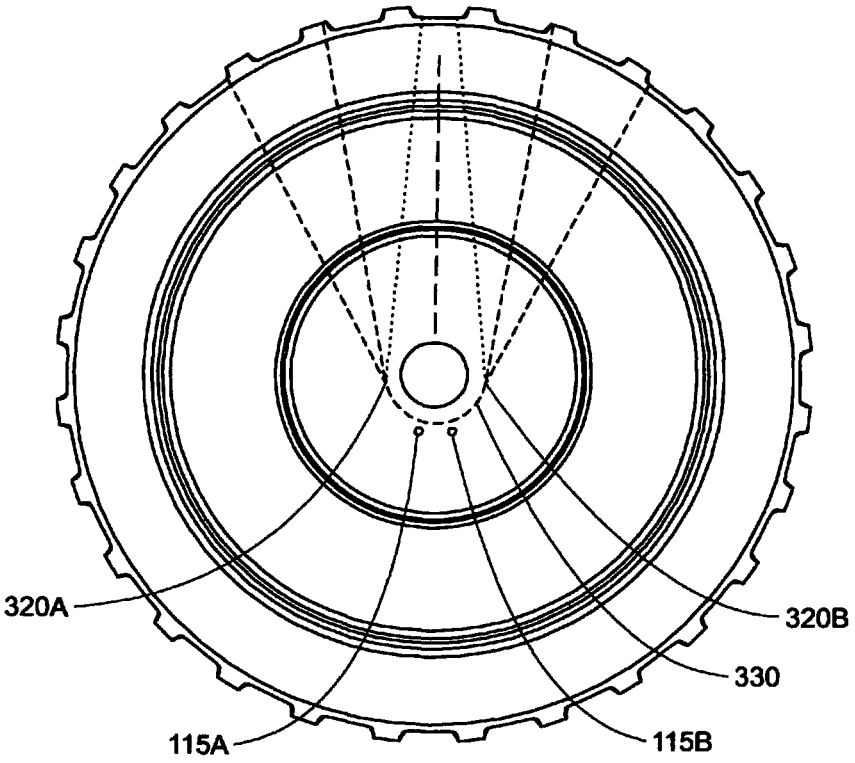
FIG. 32 is a top view schematic diagrammatic illustration of another exemplary embodiment of a crown of the present disclosure having the opener assembly placed substantially in the center of the top of the crown.

FIG. 32 illustrates another alternative exemplary embodiment in which score line apex 320A is at a position defined as being to a first side of opener assembly 110 and score line apex 320B is at a position defined as being a second side of opener assembly 110, substantially opposite apex 320A. Score line 330 extends in an arc from apex 320A to 320B and between opener assembly 110 and dimples 115A/B.

Figure 33:
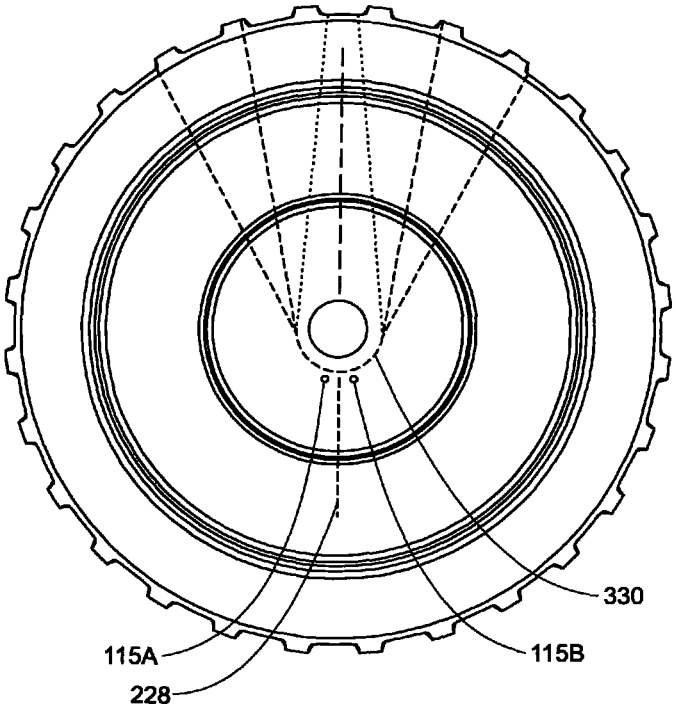
FIG. 33 is a top view schematic diagrammatic illustration of yet another exemplary embodiment of a crown of the present disclosure having the opener assembly placed substantially in the center of the top of the crown.

FIG. 33 illustrates alternative embodiment of Fig. C, which further provides bottom score line 228.

Figure 34:
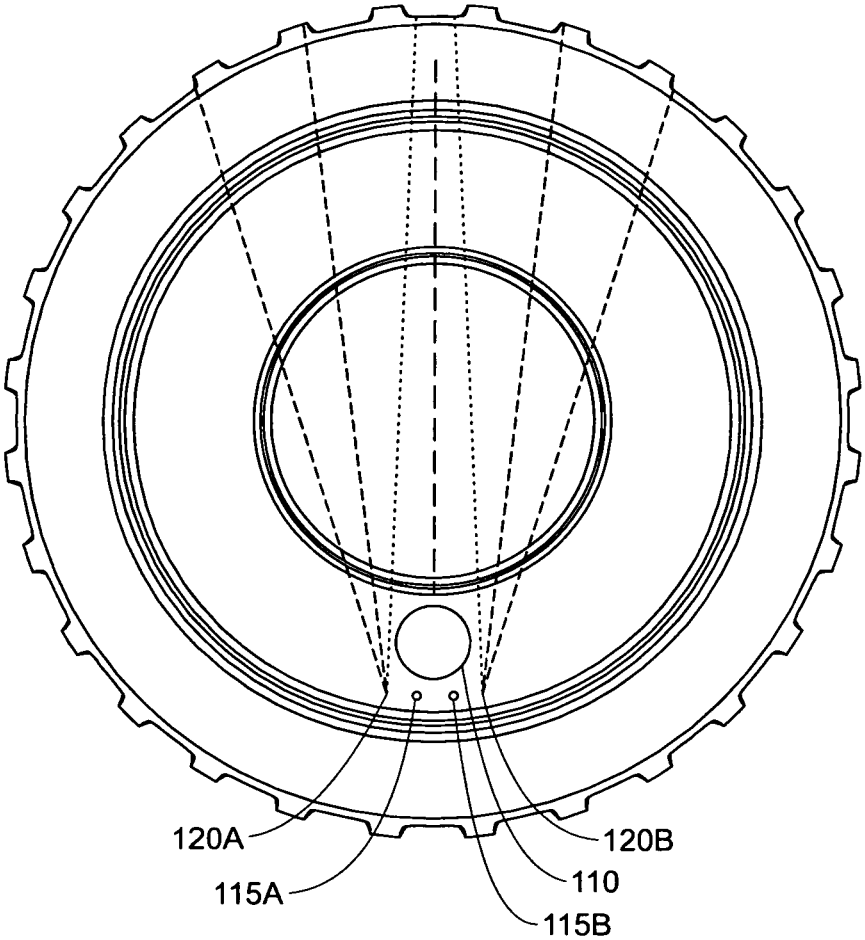
FIG. 34 is a top view schematic diagrammatic illustration of an exemplary embodiment of a crown of the present disclosure having the opener assembly placed substantially off-center on the top of the crown.
Figure 35:
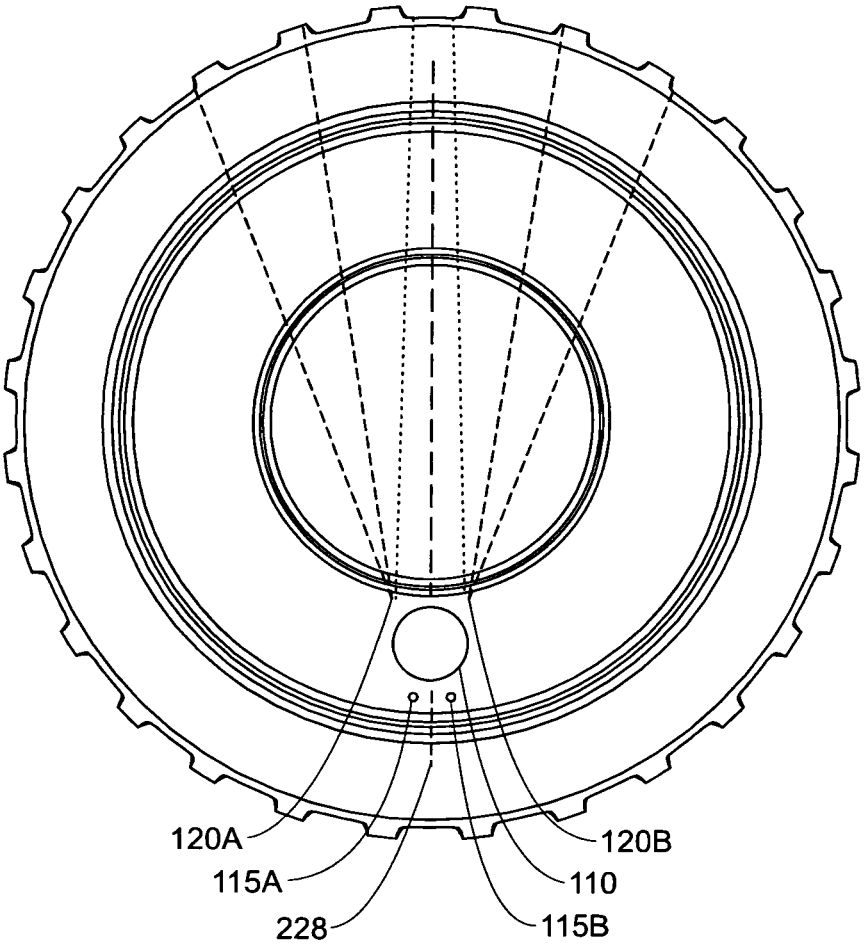
FIG. 35 is a top view schematic diagrammatic illustration of an alternative exemplary embodiment of a crown of the present disclosure having the opener assembly placed substantially off-center on the top of the crown.
Figure 36:
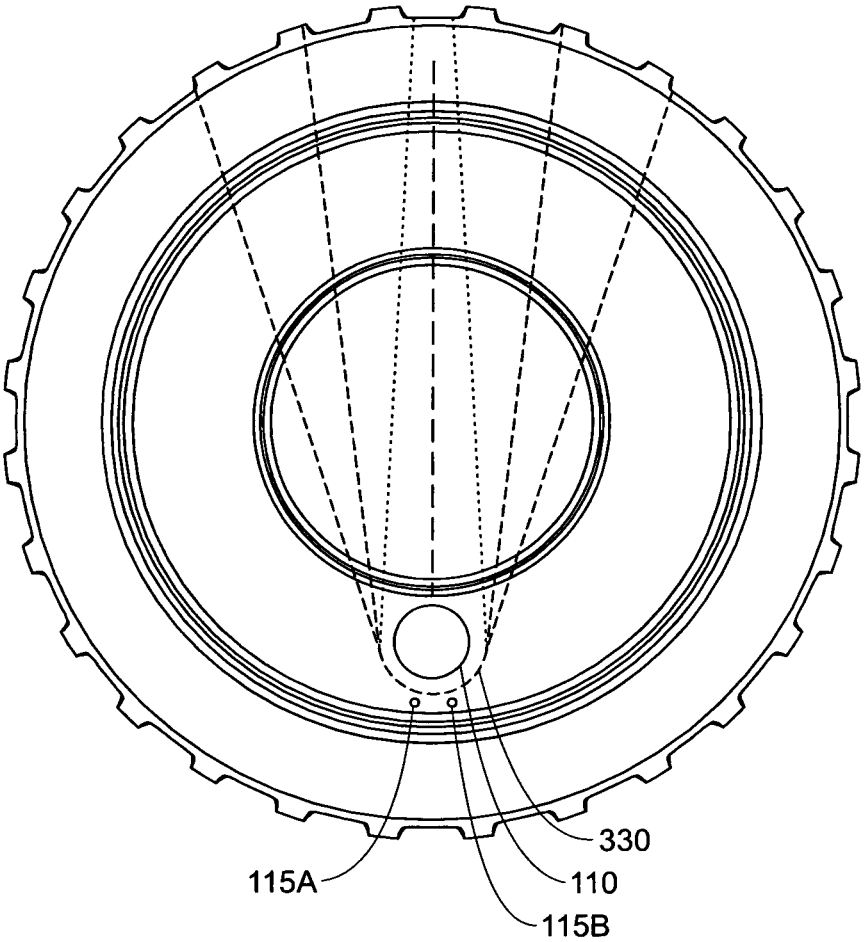
FIG. 36 is a top view schematic diagrammatic illustration of another exemplary embodiment of a crown of the present disclosure having the opener assembly placed substantially off-center on the top of the crown.
Figure 37:
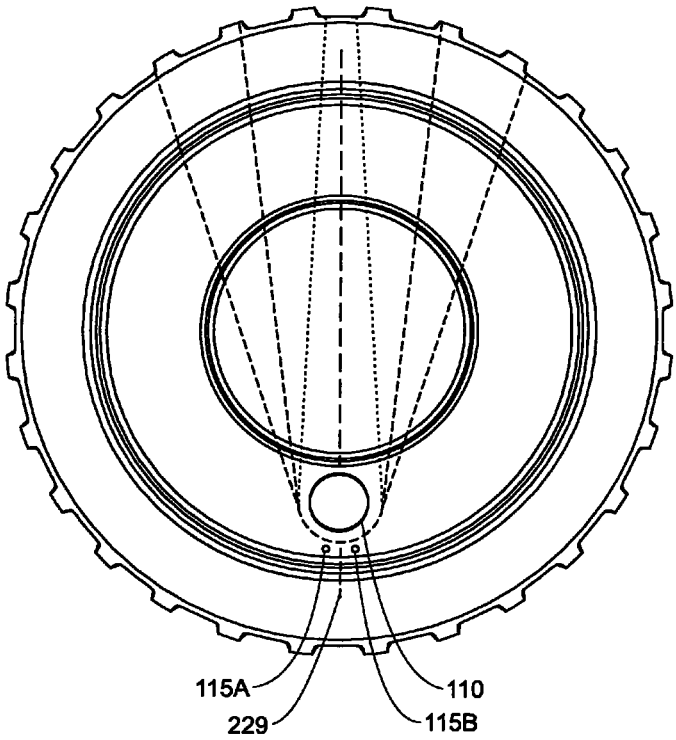
FIG. 37 is a top view schematic diagrammatic illustration of yet another exemplary embodiment of a crown of the present disclosure having the opener assembly placed substantially off-center on the top of the crown.

We now turn to the embodiments having an off-center pull tab assembly location with the various score lines corresponding to those described above for FIGS. 30-33. FIG. 34 illustrates an alternative embodiment of the Crown of FIG. 1 having an off-center opener assembly location. FIG. 35 illustrates an alternative embodiment of the Crown of Fig. B having an off-center opener assembly location. FIG. 36 illustrates an alternative embodiment of the Crown of FIG. 33 having an off-center opener assembly location. FIG. 37 illustrates an alternative embodiment of the Crown of FIG. 33 having an off-center opener assembly location. In FIGS. 35 and 37, bottom score line 229 (corresponding to 228) extends into the annular skirt, but terminates before the edge of the crown. Scoring line termini are predetermined prior to manufacture, depending on the nature of the intended container contents or other factors.

Figure 38:
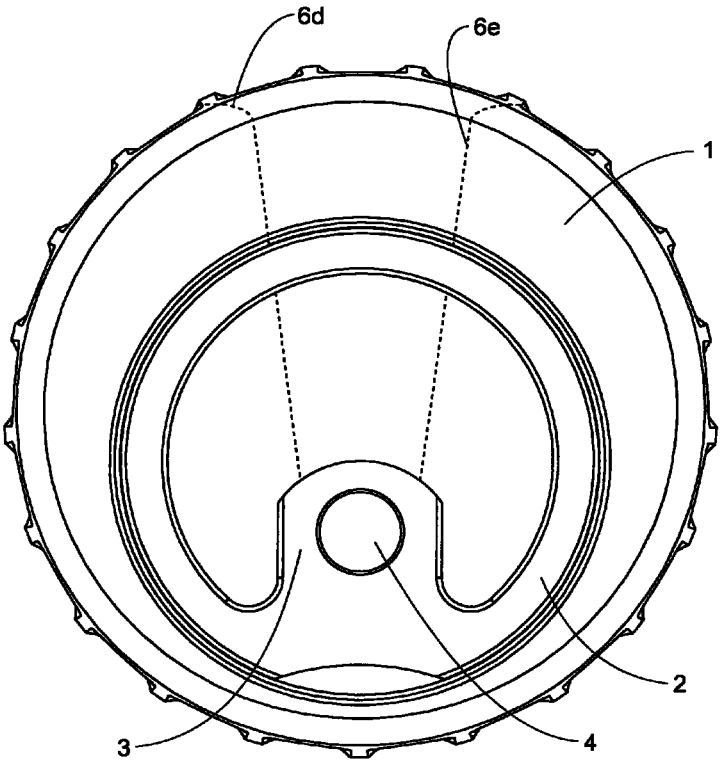
FIG. 38 is a top view diagrammatic illustration of a crown of the present disclosure with an opener assembly mounted off-center.

FIG. 38 depicts in a top view a crown of the present disclosure having an opener assembly, consisting of rivet 4, pull ring 2 and pull tab 3, mounted to the top of a crown in an off-center location.

Figure 39:
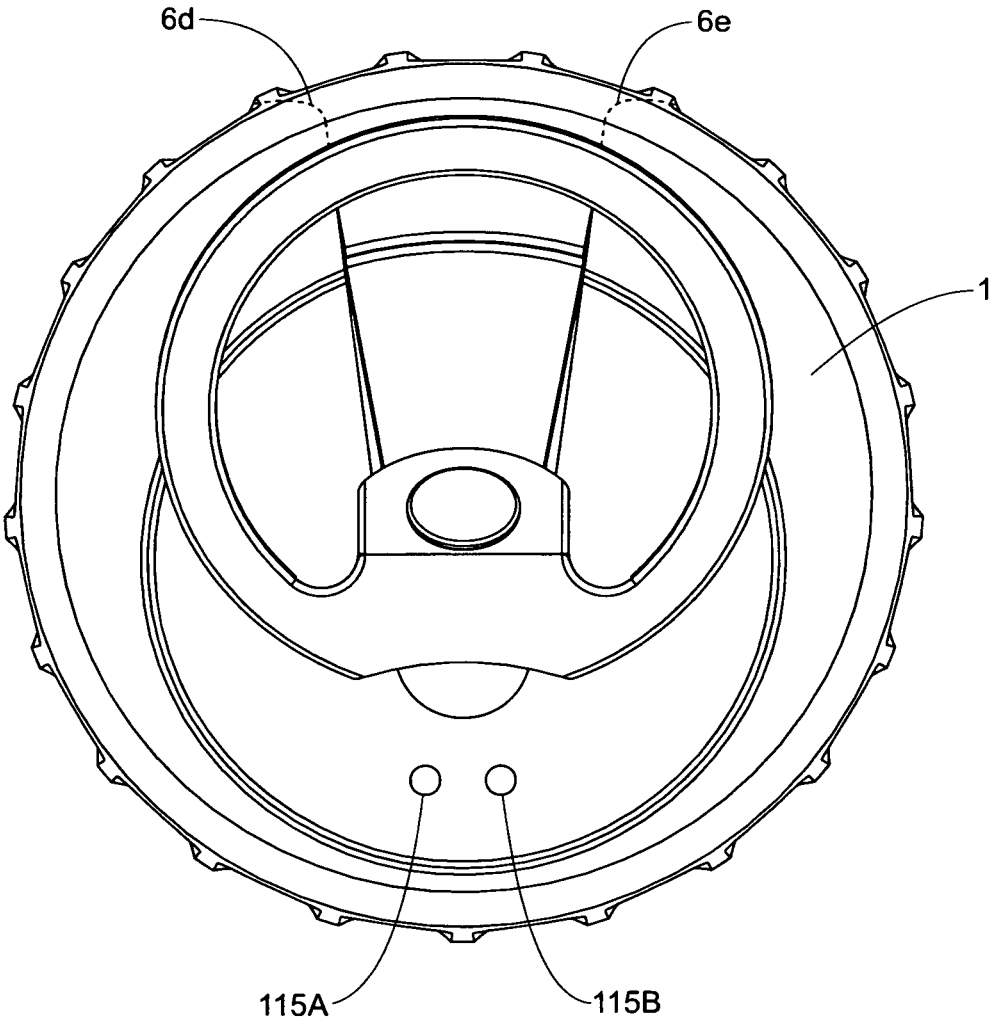
FIG. 39 is a top view diagrammatic illustration of the crown of FIG. 38 partially open.

FIG. 39 depicts the crown of FIG. 38 in a partially open position. Crown 1 is cracked open with the opener assembly along frangible score lines 6*d* and 6*f*, exposing dimples 115A/B.

Figure 40:
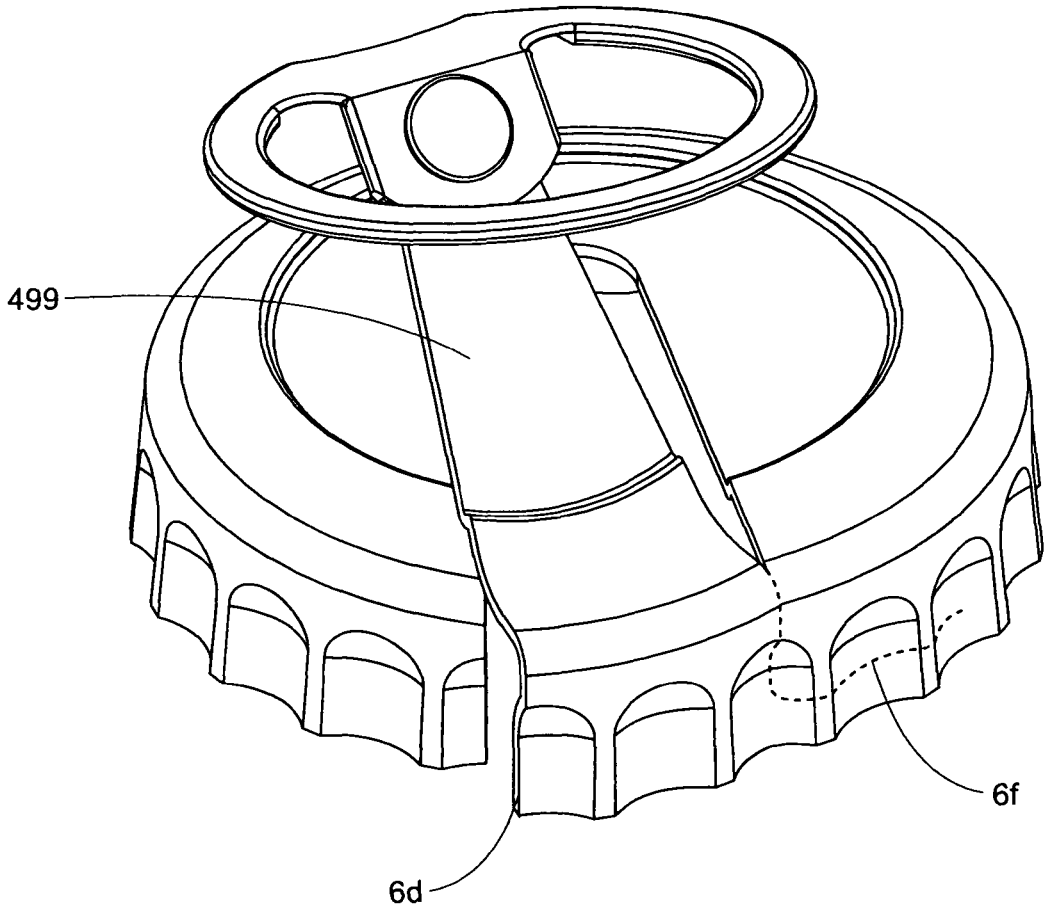
FIG. 40 is a top view diagrammatic illustration of the crown of FIG. 39 further open.

FIG. 40 depicts the crown of FIG. 39 further open so that crown 1 is detached from the contain at frangible score line 6*d*. Score line 6*f* does not extend to the edge of the skirt to maintain the crown as a unitary piece upon removal from the container. Tongue portion 499 is longer than the corresponding portion in the embodiments previously described herein due the off-center position on the opener assembly.

Figure 41:
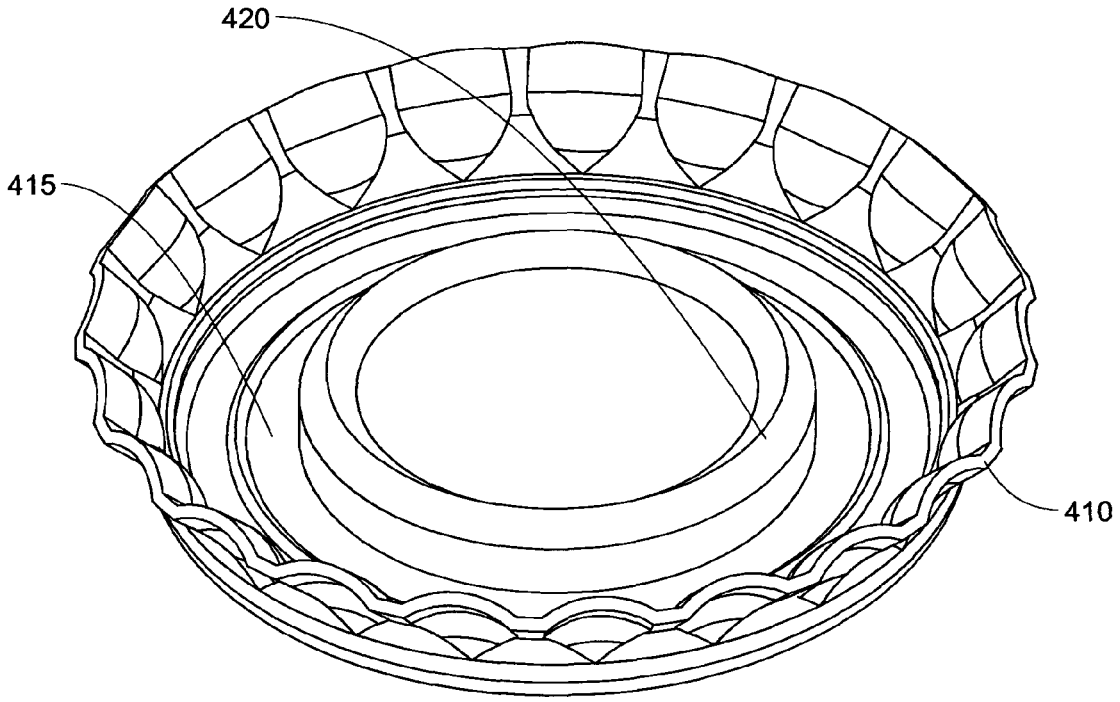
FIG. 41 is a bottom view diagrammatic illustration of a crown of the present disclosure.

FIG. 41 is a bottom perspective view diagrammatic illustration of an exemplary embodiment of a crown of the present disclosure. Fluted annular skirt 410 descends from top 415 of the crown and embossed recess 420 descends into the underside interior of the crown. Formed by skirt 410 and top 415.

Figure 42A:
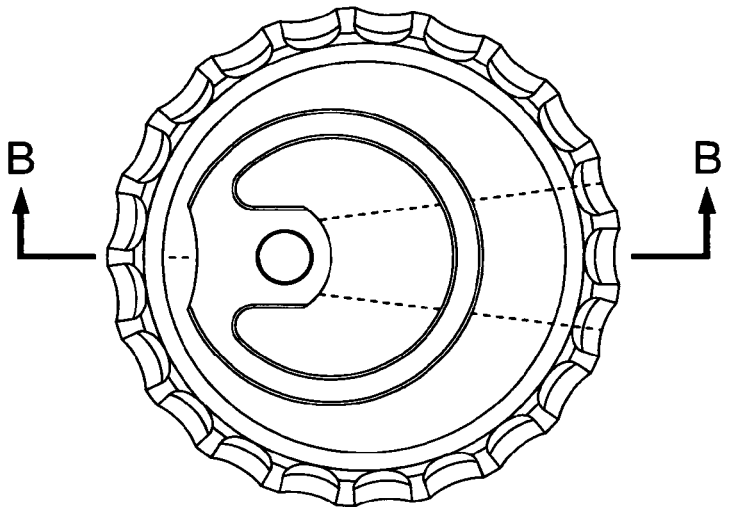
FIG. 42A-D is a side cross section views illustrating liner configurations for a crown of the present disclosure.
Figure 42B:
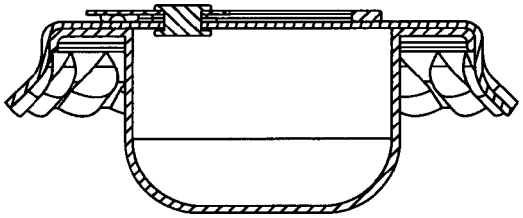
Figure 42C:
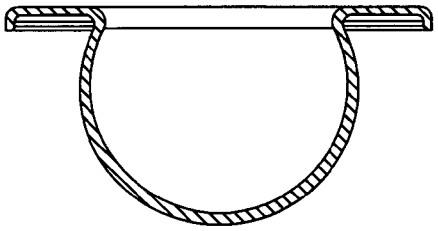
Figure 42D:
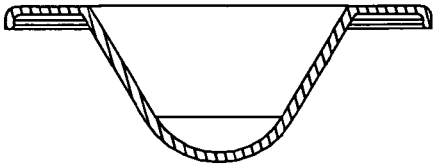

FIG. 42A is a bottom perspective view diagrammatic illustration of an exemplary embodiment of a crown of the present disclosure. FIGS. 42B-42D are side view cross sectional profiles taken along line B-B of FIG. 42A of alternative exemplary embodiments of a crown liner or gasket seal affixed to the underside (see FIG. 41) of the crown of FIG. 42A. FIG. 42B illustrates a liner having a substantially squared-off profile. FIG. 42C illustrates a liner having a substantially arcuate profile. FIG. 42C illustrates a liner having a substantially V-shaped profile, with the apex of the V-shape slightly rounded off. A crown liner enhances the gas-tight seal of a crown. The gas tight seal may be further enhanced with the selection of a liner having a desired profile. For example, the liner profiles shown in FIGS. 42B-D may be particularly effective for sealing wine and champagne bottles, which tend to have larger diameter openings than do beer of soda bottles, and which contents require a longer shelf life than beer or soda.

Figure 43A:
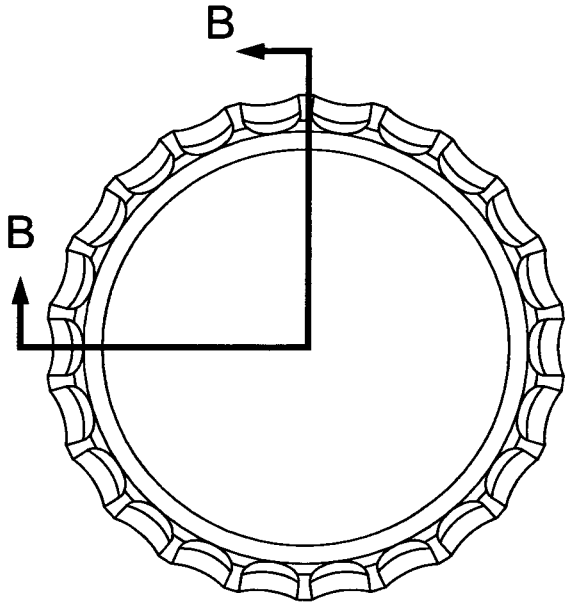
FIG. 43A-B is a side cross section views illustrating an alternative liner for a crown of the present disclosure.
Figure 43B:
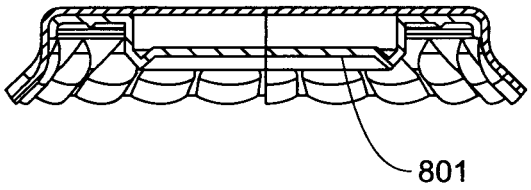

FIG. 43B is a corner cross sectional view taken along cut away wedge B-B of FIG. 43A. Liner 801 is disposed on the interior underside of crown 1 as described above. In the embodiment of this figure, the liner is preferably fabricated from a synthetic cork material, such as Nepro, for example.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural, materials, and logical substitutions and changes may be made without departing from the scope of this disclosure. Figures are merely representational and may not be drawn to scale. Certain proportions thereof may be exaggerated, while others may be minimized. Accordingly, the specification and drawings are to be regarded in an illustrative rather than a restrictive sense.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the claims reflect, inventive subject matter lies in less than all features of a single disclosed embodiment. Thus the following claims are hereby incorporated into the Detailed Description, with each claim standing on its own as a separate embodiment.

The description has made reference to several exemplary embodiments. It is understood, however, that the words that have been used are words of description and illustration, rather than words of limitation. Changes may be made within the purview of the appended claims, as presently stated and as amended, without departing from the scope and spirit of the disclosure in all its aspects. Although description makes reference to particular means, materials and embodiments, the disclosure is not intended to be limited to the particulars disclosed; rather, the disclosure extends to all functionally equivalent technologies, structures, methods and uses such as are within the scope of the appended claims.

I claim:

1. A frangible reduced gauge crown for a container opening, the crown comprising:

a top portion having a recessed attachment portion, wherein the recessed attachment portion corrugates the top portion;

an annular skirt descending from the top portion and terminating at a bottom annular edge;

an opener assembly attached to the top portion at the attachment portion;

a frangible scoring arrangement comprising frangible scoring lines formed such that at least one of the frangible scoring lines comprises connections of opposing rounded edges when viewed in cross-section such that the at least one scoring line produces a non-sharp edge on both sides of the at least one scoring line upon breaking, the frangible scoring arrangement further comprising:

a first scoring line extending in a continuous radial direction from the attachment portion to the bottom annular edge of the skirt;

a curvilinear second scoring line comprising:

an upper radial segment extending in a continuous radial direction from the attachment portion of the top portion to the annular sidewall of the skirt; and a lower annular segment extending circumferentially along the annular sidewall of the skirt from the upper radial segment to an endpoint substantially spaced from the bottom annular edge of the skirt; and an arcuate third scoring line connecting a first end of the first scoring line to a first end of the second scoring line within the recessed attachment portion.

2. The crown of claim 1, wherein the opener assembly further comprises a pull tab ring;

a pull tab attached to the pull tab ring; and a rivet attached to the pull tab and to the attachment portion of the top portion.

3. The crown of claim 2, the opener assembly further comprising a lever under the pull tab.

4. The crown of claim 1, wherein the top portion further comprises a center portion and wherein the attachment portion is at the center portion of the top portion.

5. The crown of claim 1, wherein the top portion further comprises a center portion and wherein the attachment portion is off-center from the center portion of the top portion.

6. The crown of claim 2, where in the top portion further comprises a recessed seat in the recessed attachment portion and configured to receive the opener assembly therein.

7. The crown of claim 1, comprising a divot on the top portion to facilitate manual crown removal.

8. The crown of claim 1, further comprising an interior under portion opposite of and defined by the top portion and the skirt; a liner fastened to the under portion.

9. The crown of claim 2, further comprising a cushion on the pull tab ring.

10. The crown of claim 1, further comprising a crown thickness gauge in the range of 0.12 mm to 28 mm.

11. The crown of claim 1, wherein the skirt comprises a plurality of crimping angles.

12. The crown of claim 1, wherein the skirt comprises no crimping angles.

13. The crown of claim 1, wherein the first scoring line is curvilinear.

14. A frangible crown for a container opening, the crown comprising:

a top portion having recessed attachment portion, wherein the recessed attachment portion corrugates the top portion;

an off-center opener assembly attachment portion within the recessed attachment portion and off-center with respect to a circumference of the crown;

an annular skirt descending from the top portion and terminating at a bottom annular edge;

an opener assembly attached to the top portion at the off-center attachment portion;

a frangible scoring arrangement comprising frangible scoring lines formed such that at least one of the frangible scoring lines comprises connections of opposing rounded edges when viewed in cross-section such that the at least one scoring line produces a non-sharp edge on both sides of the at least one scoring line upon breaking, the frangible scoring arrangement further comprising:

a first scoring line extending a continuous radial direction from the attachment portion to the bottom edge of the skirt; and a curvilinear second scoring line comprising:

an upper radial segment extending in a continuous radial direction from the attachment portion of the top to the annular sidewall of the skirt, and a lower annular segment extending circumferentially along the annular side wall of the skirt from the upper radial segment to an endpoint substantially spaced from the bottom annular edge of the skirt.

15. The crown of claim 1, further comprising a fourth scoring line extending in a second direction opposite to the first direction, a first end of the fourth scoring line located proximate to the arcuate third scoring line.

16. The crown of claim 14, wherein the opener assembly comprises:

a pull tab ring;

a pull tab attached to the pull tab ring; and a rivet attached to the pull tab and to the off-center attachment portion of the top portion.

17. The crown of claim 14, wherein the recessed attachment portion is also off-center with respect to a circumference of the crown, and concentric with the off-center attachment portion.

18. The crown of claim 14, where in the top portion further comprises a recessed seat in the recessed attachment portion and configured to receive the opener assembly therein.

19. The crown of claim 14, comprising a fingernail divot on the top portion to facilitate manual crown removal.

20. The crown of claim 14, further comprising an interior under portion opposite of and defined by the top portion and the skirt; a liner fastened to the under portion.

21. The crown of claim 14, wherein the skirt comprises a plurality of crimping angles.

22. The crown of claim 14, wherein the skirt comprises no crimping angles.

23. The crown of claim 14, wherein the first scoring line is curvilinear.

24. The crown of claim 14, further comprising an arcuate third scoring line connecting a first end of the first scoring line to a first end of the second scoring line within the recessed attachment portion.

25. The crown of claim 24, further comprising a fourth scoring line extending in a second direction opposite to the first direction, a first end of the fourth scoring line located proximate to the arcuate third scoring line.

* * * * *